US006689552B2

(12) United States Patent
Ly et al.

(10) Patent No.: US 6,689,552 B2
(45) Date of Patent: Feb. 10, 2004

(54) COLOR PHOTOGRAPHIC SILVER HALIDE MATERIAL

(75) Inventors: Cuong Ly, Köln (DE); Edgar Draber, Odenthal (DE); Matthias Feigl, Leverkusen (DE); Günter Helling, Odenthal (DE); Thomas Kaluschke, Leichlingen (DE); Michael Missfeldt, Leichlingen (DE); Maria Nietgen, Leverkusen (DE); Heinz-Horst Teitscheid, Köln (DE); Ralf Weimann, Leverkusen (DE); Heinz Wiesen, Euskirchen (DE)

(73) Assignee: Agfa-Gevaert (BE)

( * ) Notice: Subject to any disclaimer, the term of this patent is extended or adjusted under 35 U.S.C. 154(b) by 87 days.

(21) Appl. No.: 10/011,561

(22) Filed: Nov. 5, 2001

(65) Prior Publication Data

US 2003/0064331 A1 Apr. 3, 2003

(30) Foreign Application Priority Data

Nov. 7, 2000 (DE) ..... 100 55 094

(51) Int. Cl.[7] ..... G03C 1/08; G03C 7/26; G03C 7/32

(52) U.S. Cl. ..... 430/552; 430/553; 430/558; 430/567; 430/570; 430/576; 430/581; 430/604; 430/605; 430/607; 430/611; 430/598; 430/600

(58) Field of Search ..... 430/543, 552, 430/553, 558, 567, 570, 576, 581, 604, 605, 607, 611, 598, 600

(56) References Cited

U.S. PATENT DOCUMENTS

| | | | | |
|---|---|---|---|---|
| 5,278,041 A | | 1/1994 | Murakami et al. | 430/604 |
| 5,320,938 A | * | 6/1994 | House et al. | 430/605 |
| 5,500,329 A | | 3/1996 | Kawai et al. | 430/363 |

FOREIGN PATENT DOCUMENTS

| | | |
|---|---|---|
| EP | 350 046 | 1/1990 |
| EP | 476 602 | 3/1992 |
| EP | 488 737 | 6/1992 |
| EP | 774 689 | 5/1997 |
| EP | 816 918 | 1/1998 |
| EP | 952 484 | 10/1999 |

* cited by examiner

*Primary Examiner*—Geraldine Letscher
(74) *Attorney, Agent, or Firm*—Connolly Bove Lodge & Hutz LLP

(57) ABSTRACT

A color photographic silver halide material which can be developed to form a negative, at least 95 mol % of the silver halides of which consist of AgCl, and which contains at least one light-sensitive silver halide emulsion layer, the silver halide of which contains at least one compound of formulae (I), (II) and (III):

$$[IrCl_nF_{6-n}]^{2-}M^{2+} \quad (I)$$

wherein n denotes 0 or an integer from 1 to 6 and $M^{2+}$ denotes 1 or 2 cations with a total number of 2 positive charges, $$[Fe(CN)_6]^{m-}M^{m+} \quad (II)$$

wherein m denotes 2 or 3 and $M^{m+}$ denotes 1 to 3 cations with a total number of m positive charges, (III)

wherein o denotes 0, 1 or 2 and R denotes an alkyl, aryl or aralkyl, is distinguished under scanning exposure and on analogue exposure by sharp contrast which is independent of exposure time and by a stable latent image.

11 Claims, No Drawings

COLOR PHOTOGRAPHIC SILVER HALIDE MATERIAL

This invention relates to a color photographic silver halide material which can be developed to form a negative, and which comprises a support, at least one blue-sensitive silver halide emulsion layer which contains at least one yellow coupler, at least one green-sensitive silver halide emulsion layer which contains at least one magenta coupler, and at least one red-sensitive silver halide emulsion layer which contains at least one cyan coupler, at least 95% of the silver halide emulsions of which consist of AgCl, and which under scanning exposure and under analogue exposure is distinguished by sharp contrast which is independent of exposure time, and by a stable latent image.

In order to produce "digital prints", photographic material is inserted in scanning photographic exposure devices in which the exposure unit exposes the image information material on to the photographic material pixel by pixel, line by line or area by area, using directed light of high intensity (typically from lasers, from light-emitting diodes (LEDs), from devices which are termed DMDs (digital micromirror devices) or from comparable devices) and with very short exposure times per pixel (of the order of nano- to microseconds). At high densities in particular, the problem of line obliteration occurs. This is manifested in the image by a blurred depiction of the edges where there is a large difference in density (e.g. written characters) in the subject, and is a graphically described as "bloom", "color fringe formation", "blurring", etc. This limits the usable range of densities of the photographic material. Therefore, photographic materials for the production of "digital prints" of high image quality in scanning photographic exposure devices comprising LEDs or lasers have to exhibit only a slight extent of line obliteration at high color density (blackening).

PRIOR ART, AND OBJECT OF THE PRESENT INVENTION

It is known of from EP 774 689 that in order to achieve a higher color density without color fringe formation during pixel by pixel exposure with directed light of high intensity (typically from gas or diode lasers, from LEDs or from comparable devices) and at very short exposure times per pixel (typically of the order of nano- to microseconds), the gradation of the light-sensitive layers of the color negative paper used should be as steep as possible over the range of exposure times used.

It is known from EP 350 046 and from U.S. Pat. No. 5,500,329 that the gradation within the exposure range of seconds or milliseconds can be steepened by doping the silver halides with metal ions of transition metals of Group II and of Group VIII of the periodic table of the elements.

Moreover, it is known from EP 350 046 that doping of silver chloride or silver chloride-bromide emulsions with compounds of iridium and iron can reduce the fluctuation of photographic properties during a continuous chemical process.

Furthermore, it is known from JP 3 188 437, EP 476 602, JP 4 204 941, JP 4 305 644, EP 816 918 and EP 952 484 that doping silver chloride or silver chloride bromide emulsions with compounds of iridium and iron, in combination with other compounds or with other measures, can reduce the reciprocity failure of the emulsions.

It has been found, however, that when using these measures one of the most important photographic properties, namely the latent image stability, is not satisfactory.

The object of the present invention was to provide a material which is suitable for digital exposure and for analogue exposure and which is distinguished by steep gradation, irrespective of exposure times, and by stable latent image properties.

SUBJECT MATTER OF THE PRESENT INVENTION

This object is surprisingly achieved if the color photographic material described at the outset contains at least one light-sensitive silver halide emulsion layer, which contains at least one compound of formulae (I) (II) and (III):

$$[IrCl_nF_{6-n}]^{2-}M^{2+} \quad (I)$$

wherein n denotes 0 or an integer from 1 to 6 and $M^{2+}$ denotes 1 or 2 cations with a total number of 2 positive charges, $$[Fe(CN)_6]^{m-}M^{m+} \quad (II)$$

wherein m denotes 2 or 3 and $M^{+}$ denotes 1 to 3 cations with a total number of m positive charges, (III)

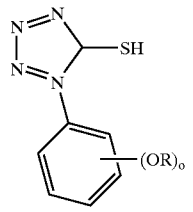

wherein o denotes 0, 1 or 2 and R denotes an alkyl, aryl or aralkyl.

The emulsion which is used according to the invention is preferably produced either by a simple double-jet method, by a double-jet method with pre-precipitation and precipitation, or by a combined double-jet-redissolution method.

The silver halide emulsion preferably contains silver halide grains comprising at least two different zones, wherein the nucleus is produced by a double-jet method using an $AgNO_3$ solution and a halide solution, essentially a chloride solution, and the precipitate is produced by redissolving a very fine-grained silver halide emulsion (a so-called micrate emulsion) on to the pre-precipitate.

In the double-jet method, the compounds of formulae (I) and (II) are preferably introduced via the halide solution.

In the double-jet-redissolution method, the compound of formula (I) is introduced via the micrate emulsion, and the compound of formula (II) is introduced via the halide solution during the double-jet precipitation or both compounds are introduced via the micrate emulsion.

The compound of formula (III) is preferably added before or during chemical ripening.

The following amounts are preferably used per mol Ag of silver halide emulsion:

10 nmol to 5 $\mu$mol of the compound of formula (I)

10 nmol to 10 $\mu$mol of the compound of formula (II)

0.1 nmol to 5 $\mu$mol of the compound of formula (III).

In one preferred embodiment, yellow couplers, magenta couplers and cyan couplers of formulae (IV), (V), (VI) and (VII) are used.

Yellow Couplers (IV)

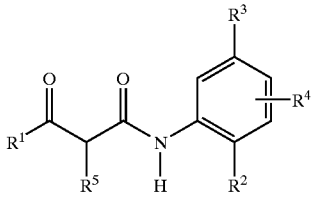

wherein $R^1$ denotes an alkyl, alkoxy, aryl or hetaryl, $R^2$ denotes an alkoxy, an aryloxy or a halogen, $R^3$ denotes $—CO_2R^6—CONR^6R^7$, $—NHCO_2R^6$, $—NHSO_2—R^6$, $—SO_2NR^6R^7$, $—SO_2NHCOR^6$ or $—NHCOR^6$, $R^4$ denotes hydrogen or a substituent, $R^5$ denotes hydrogen or a radical which can be split off during coupling, $R^6$ and $R^7$, independently of each other, denote hydrogen, alkyl or aryl and one of the $R^2$, $R^3$ and $R^4$ radicals is a ballast radical.

Magenta Couplers (V)

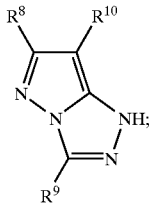

(VI)

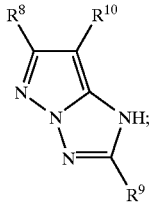

wherein $R^8$ and $R^9$, independently of each other, denote hydrogen, alkyl, aralkyl, aryl, aryloxy, alkylthio, arylthio, amino, anilino, acylamino cyano, alkoxycarbonyl, alkylcarbamoyl or alkylsulphamoyl, wherein these radicals can be further substituted and wherein at least one of these radicals contains a ballast group, and $R^{10}$ denotes hydrogen or a radical which can be split off during chromogenic coupling.

$R^8$ is preferably tert.-butyl; $R^{10}$ is preferably chlorine.

Cyan Couplers (VII)

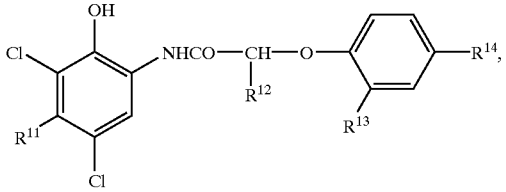

wherein $R^{11}$, $R^{12}$, $R^{13}$ and $R^{14}$, independently of each other, denote hydrogen or a $C_1$–$C_6$ alkyl.

$R^{11}$ is preferably $CH_3$ or $C_2H_5$.

$R^{12}$ is preferably a $C_2$–$C_6$ alkyl, $R^{13}$ and $R^{14}$ are preferably t-$C_4H_9$ or t-$C_5H_{11}$.

(VIII)

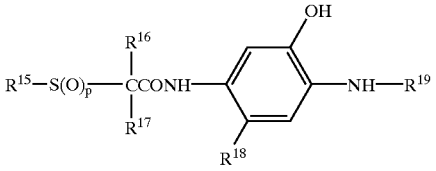

wherein $R^{15}$ denotes alkyl, alkenyl, aryl or hetaryl, $R^{16}$ and $R^{17}$ denote H, alkyl, alkenyl, aryl or hetaryl, $R^{18}$ denotes H or a group which can be split off under the conditions of chromogenic development, $R^{19}$ denotes $—COR^{20}$, $—CO_2R^{20}$, $—CONR^{20}R^{21}$, $—SO_{20}R^{21}$, $—CO—CO_2R^{20}$, $—COCONR^{20}R^{21}$, or a group of formula

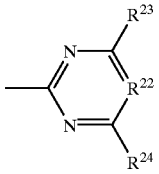

$R^{20}$ denotes alkyl, alkenyl, aryl or hetaryl, $R^{21}$ denotes H or $R^{20}$, $R^{22}$ denotes —N═ or $—C(R^{25})═$, $R^{23}$, $R^{24}$ and $R^{25}$ denote $OR^{21}$, $—SR^{21}$, $—NR^{20}R^{21}$, $—R^{21}$ or Cl, and p denotes 1 or 2.

Within formula (VIII), the following groups of couplers are preferred:

(1) couplers in which p denotes 1 and $R^{15}$ to $R^{25}$ have the aforementioned meanings.

(2) couplers in which p denotes 2, $R^{19}$ denotes $—CO—R^{26}$ and $R^{26}$ denotes an alkenyl or hetaryl, and $R^{15}$ to $R^{18}$ have the aforementioned meanings.

(3) couplers in which p denotes 2, $R^{19}$ denotes $—SO_2R^{27}$, $—SO_2N(R^{27})_2$, $—CO_2R^{27}$, $—COCO_2—R^{27}$ or $—COCO—N(R^{27})_2$ and $R^{27}$ denotes an alkyl, aryl, alkenyl or hetaryl, and $R^{15}$ to $R^{18}$ have the aforementioned meanings.

(4) couplers in which p denotes 2, and $R^{19}$ denotes a radical of formula

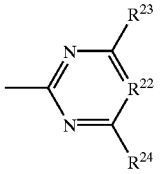

and $R^{15}$ to $R^{18}$ and $R^{22}$ to $R^{24}$ have the aforementioned meanings.

(5) couplers in which p denotes 2 and $R^{19}$ denotes a radical of formula

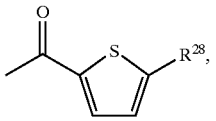

wherein $R^{28}$ denotes H, Cl, CN, Br, F, —$COR^{29}$, —$CONHR^{29}$ or $CO_2R^{29}$, and $R^{29}$ denotes an alkyl or aryl.

In formula (VIII) and compounds (1) to (5), the substituents have the following preferred meanings:

$R^{15}$ denotes alkyl or aryl, $R^{16}$ and $R^{17}$ denote H, alkyl or aryl, $R^{18}$ denotes H, Cl, alkoxy, aryloxy, alkylthio or arylthio, $R^{22}$ denotes —N═, $R^{23}$ and $R^{24}$ denote —$OR^{21}$, —$NR^{20}R^{21}$, —Cl.

The following meanings are quite particularly preferred:

$R^{17}$ denotes H, and $R^{20}$ denotes an alkyl or aryl.

The alkyl and alkenyl radicals can be straight chain, branched or cyclic and can themselves be substituted.

The aryl and hetaryl radicals can themselves be substituted, wherein aryl denotes phenyl in particular.

Possible substituents for alkyl, alkenyl, aryl or hetaryl radicals include: alkyl, alkenyl, aryl, hetaryl, alkoxy, aryloxy, alkenyloxy, hydroxy, alkylthio, arylthio, a halogen, cyano, acyl, acyloxy and acylamino, wherein an acyl radical can originate from an aliphatic olefinic or from an aromatic carboxylic, carbonic, carbamic, sulphonic, sulphonamido, sulphinic, phosphoric, phosphonic or phosphorous acid.

Examples of cyan couplers of formula VII include:

VII-1, where $R^{11}=C_2H_5$, $R^{12}=n\text{-}C_4H_9$, $R^{13}=R^{14}=t\text{-}C_4H_9$, VII-2, where $R^{11}=R^{12}=C_2H_5$, $R^{13}=R^{14}=t\text{-}C_5H_{11}$, VII-3, where $R^{11}=C_2H_5$, $R^{12}=n\text{-}C_3H_7$, $R^{13}=R^{14}=t\text{-}C_5H_{11}$, VII-4, where $R^{11}=CH_3$, $R^{12}=C_2H_5$, $R^{13}=R^{14}=t\text{-}C_5H_{11}$.

Examples of cyan couplers of formula (VIII) where p=2 include:

| No. | $R^{16}$ | $R^{17}$ | $R^{15}$ | $R^{19}$ | $R^{18}$ |
|---|---|---|---|---|---|
| VIII-1 | $—C_2H_5$ | H | 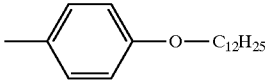 | 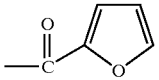 | —Cl |
| VIII-2 | $—C_2H_5$ | H | 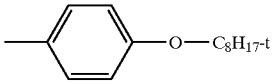 | 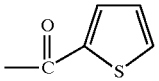 | —H |
| VIII-3 | $—C_6H_{13}$ | H | 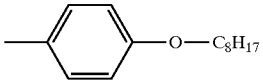 | 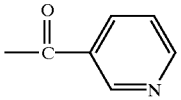 | $—OCH_2CH_2—SCH_2COOH$ |
| VIII-4 | -Phenyl | H | 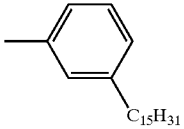 | 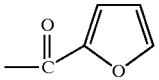 | —Cl |
| VIII-5 | $—CH_3$ | $—CH_3$ | $—C_{16}H_{33}$ | 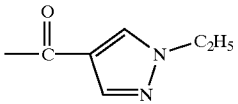 | —Cl |
| VIII-6 | -Phenyl | H | $—C_{12}H_{27}$ | 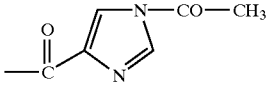 | $—SCH_2CH_2—COOH$ |
| VIII-7 | $—C_2H_5$ | H | 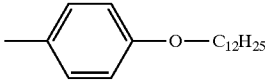 | 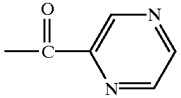 | $—O—CH_2—COOCH_3$ |

-continued
| No. | $R^{16}$ | $R^{17}$ | $R^{15}$ | $R^{19}$ | $R^{18}$ |
|---|---|---|---|---|---|
| VIII-8 | $C_{12}H_{25}$ | H | 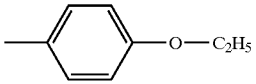 | 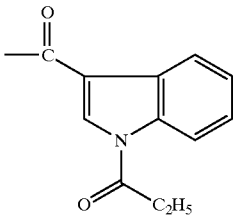 | —Cl |
| VIII-9 | $—C_3H_7$-i | H | 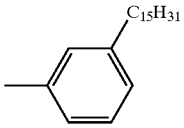 | 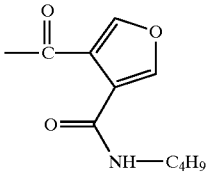 | —Cl |
| VIII-10 | $—CH_3$ | $—CH_3$ | 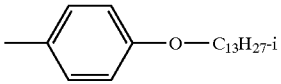 | 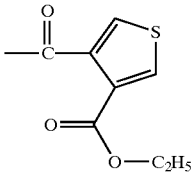 | 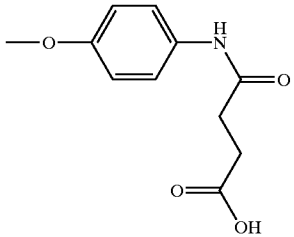 |
| VIII-11 | $—C_2H_5$ | H | 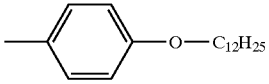 | 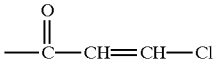 | —Cl |
| VIII-12 | -Phenyl | H | $—C_{16}H_{33}$ | 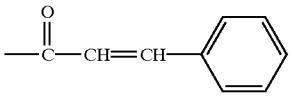 | H |
| VIII-13 | $—C_{12}H_{25}$ | H | 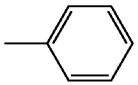 | 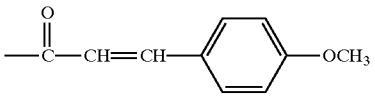 | —Cl |

-continued
| No. | $R^{16}$ | $R^{17}$ | $R^{15}$ | $R^{19}$ | $R^{18}$ |
|---|---|---|---|---|---|
| VIII-14 | $—C_4H_9$ | H | 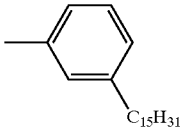 | 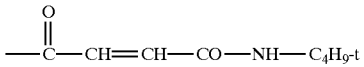 | $—OCH_2COOCH_3$ |
| VIII-15 | $—CH_3$ | $—CH_3$ | 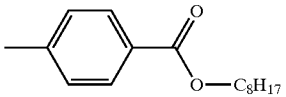 | 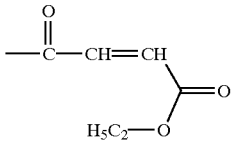 | —Cl |
| VIII-16 | $—C_2H_5$ | H | 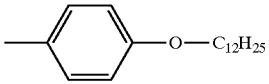 | $—SO_2—C_4H_9$ | —Cl |
| VIII-17 | $—C_2H_5$ | H | 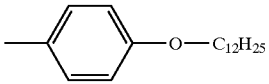 | $—CO—O—C_4H_9$-i | —Cl |
| VIII-18 | $—C_3H_7$-i | H | 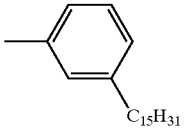 | 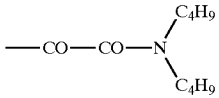 | $—OCH_2—COOCH_3$ |
| VIII-19 | -Phenyl | H | 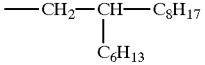 | $—SO_2—NH—C_4H_9$-t | H |
| VIII-20 | $—C_6H_{13}$ | H | 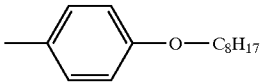 | 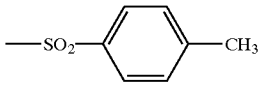 | H |
| VIII-21 | $—CH_3$ | $—CH_3$ | 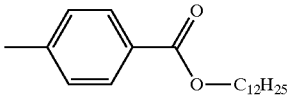 | $—CO—CO—OC_2H_5$ | —Cl |

-continued
| No. | $R^{16}$ | $R^{17}$ | $R^{15}$ | $R^{19}$ | $R^{18}$ |
|---|---|---|---|---|---|
| VIII-22 | —$C_4H_9$ | H | 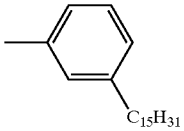 | —$SO_2$—$CH_3$ | —Cl |
| VIII-23 | -Phenyl | -Phenyl | —$C_{12}H_{25}$ | —$SO_2$—$C_4H_9$ | —$SCH_2CH_2$—COOH |
| VIII-24 | —$C_{12}H_{25}$ | H | 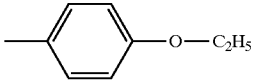 | —CO—O—$C_2H_5$ | —Cl |
| VIII-25 | —$C_2H_5$ | H | 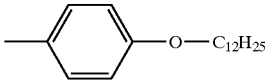 | 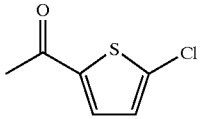 | Cl |
| VIII-26 | —$CH_3$ | H | 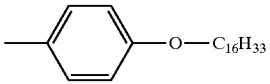 | 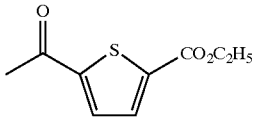 | Cl |
| VIII-27 | —$C_2H_5$ | H | 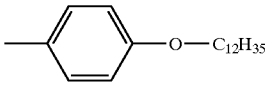 | 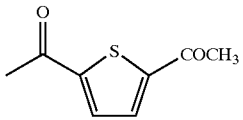 | Cl |

Examples of cyan couplers of formula (VIII), where p = 2 and include:
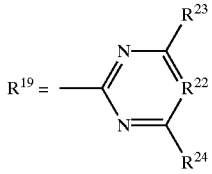
| No. | $R^{16}$ | $R^{17}$ | $R^{15}$ | $R^{23}$ | $R^{24}$ | $R^{22}$ | $R^{18}$ |
|---|---|---|---|---|---|---|---|
| VIII-28 | $—C_2H_5$ | H | 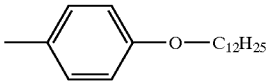 | $—N(C_4H_9)_2$ | $—N(C_4H_9)_2$ | —N= | —C— |
| VIII-29 | $—C_2H_5$ | H | 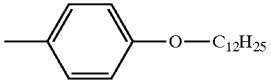 | —NH—$CH_2$—CH($C_2H_5$)—$C_4H_9$ | —NH—$CH_2$—CH($C_2H_5$)—$C_4H_9$ | —N= | —Cl |
| VIII-30 | $—C_2H_5$ | H | 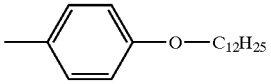 | $—OCH_3$ | $—OCH_3$ | —N= | —Cl |
| VIII-31 | $—C_6H_{13}$ | H | 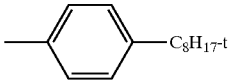 | —Cl | $—NH—C_4H_9$ | $—C(NHC_4H_9)=$ | H |

-continued
Examples of cyan couplers of formula (VIII), where p = 2 and include:
$R^{19}$ = 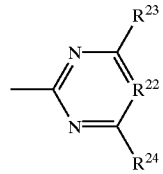
| No. | $R^{16}$ | $R^{17}$ | $R^{15}$ | $R^{23}$ | $R^{24}$ | $R^{22}$ | $R^{18}$ |
|---|---|---|---|---|---|---|---|
| VIII-32 | -Phenyl | H | —$C_{12}H_{25}$ | —$OCH_3$ | —$N(C_4H_9)_2$ | —N= | —$OCH_2COOCH_3$— |
| VIII-33 | —$CH_3$ | —$CH_3$ | 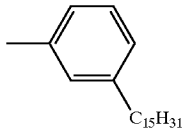 | —NH—$C_4H_9$ | —NH—$C_4H_9$ | —$C(N(C_2H_5)_2)$= | —Cl |
| VIII-34 | H | H | 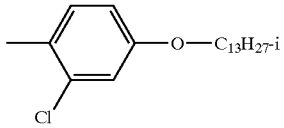 | —$OCH_3$ | —NH—$C_4H_9$ | —N= | —S—$CH_2CH_2$—COOH |
| VIII-35 | —$CH_3$ | H | 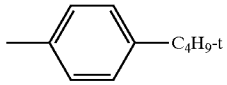 | —Cl | —N—(—$CH_2$—CH($C_2H_5$)—$C_4H_9$)$_2$ | —N= | —Cl |

Examples of cyan couplers, where p = 1, include:
| Nr. | $R^{16}$ | $R^{17}$ | $R^{15}$ | $R^{19}$ | $R^{18}$ |
|---|---|---|---|---|---|
| VIII-36 | $—C_2H_5$ | H | 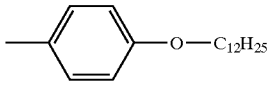 | 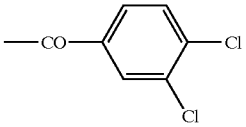 | —Cl |
| VIII-37 | $—C_4H_9$ | H | 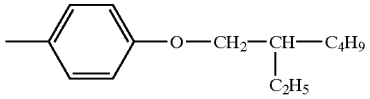 | $—CO—C_3F_7$ | —Cl |
| VIII-38 | $—C_6H_{13}$ | H | 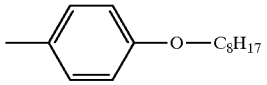 | 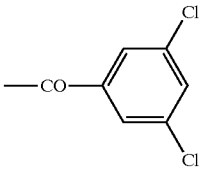 | $—OCH_2CH_2—S—CH_2COOH$ |
| VIII-39 | $—CH_3$ | $—CH_3$ | 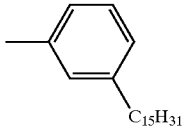 | 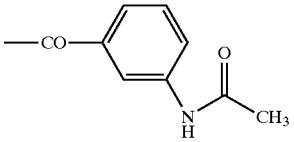 | H |
| VIII-40 | -Phenyl | H | 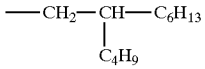 | 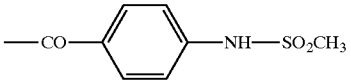 | —Cl |
| VIII-41 | $—C_2H_5$ | H | 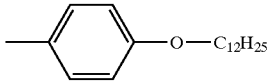 | 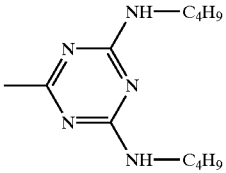 | H |

-continued
Examples of cyan couplers, where p = 1, include:
| Nr. | $R^{16}$ | $R^{17}$ | $R^{15}$ | $R^{19}$ | $R^{18}$ |
|---|---|---|---|---|---|
| VIII-42 | $—C_{12}H_{25}$ | H | 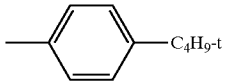 | 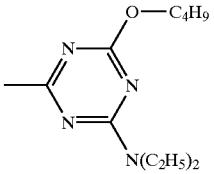 | 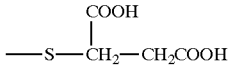 |
| VIII-43 | $—C_4H_9$ | H | $—C_{12}H_{25}$ | 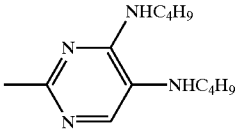 | —Cl |
| VIII-44 | $—C_2H_5$ | H | 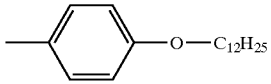 | $—SO_2—C_4H_9$ | —Cl |
| VIII-45 | $—C_3H_7$-i | H | $—C_{16}H_{33}$ | 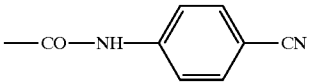 | $—O—CH_2—COO—CH_3$ |
| VIII-46 | $—CH_2CH_2CH_2CH_2—$ | | 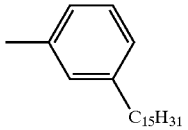 | 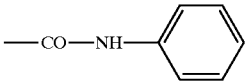 | —Cl |
| VIII-47 | $—C_2H_5$ | $—C_2H_5$ | 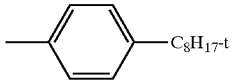 | $—CO—O—C_4H_9$-i | H |
| VIII-48 | -Phenyl | H | $—C_{12}H_{25}$ | $—CO—CO—N(C_4H_9)_2$ | 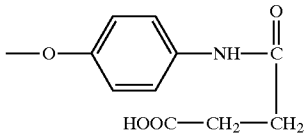 |

-continued
Examples of cyan couplers, where p = 1, include:
| Nr. | $R^{16}$ | $R^{17}$ | $R^{15}$ | $R^{19}$ | $R^{18}$ |
|---|---|---|---|---|---|
| VIII-49 | $—C_{12}H_{25}$ | H | 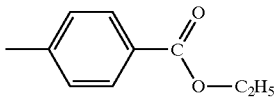 | —CO—CH═CH—CO—<br>$N(C_2H_5)_2$ | —Cl |
| VIII-50 | $—C_2H_5$ | H | 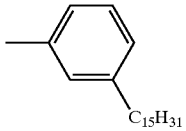 | 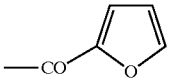 | —Cl |
| VIII-51 | $—C_6H_{13}$ | H | 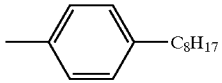 | 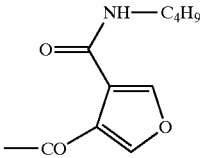 | H |
| VIII-52 | $—C_4H_9$ | H | 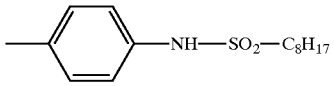 | 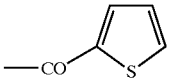 | —Cl |
| VIII-53 | $—CH_3$ | H | 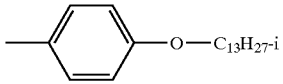 | 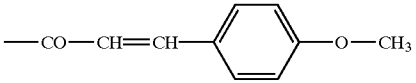 | —Cl |
| VIII-54 | -Phenyl | H | 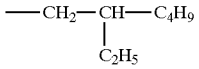 | 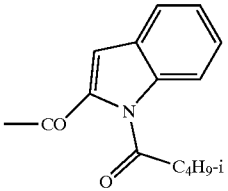 | H |
| VIII-55 | $—C_2H_5$ | H | 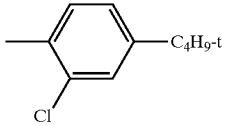 | 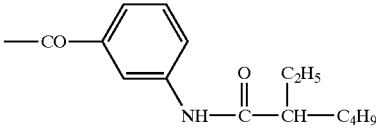 | —Cl |

-continued
Examples of cyan couplers, where p = 1, include:
| Nr. | $R^{16}$ | $R^{17}$ | $R^{15}$ | $R^{19}$ | $R^{18}$ |
|---|---|---|---|---|---|
| VIII-56 | $—C_2H_5$ | H | 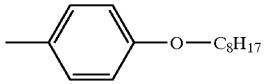 | 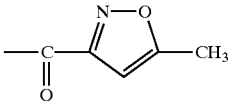 | Cl |
| VIII-57 | $—C_3H_7$ | H | 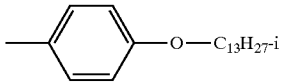 | 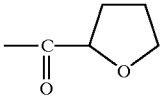 | Cl |
| VIII-58 | $—C_2H_5$ | H | 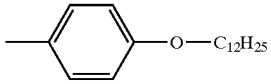 | 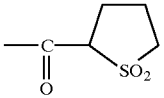 | H |
| VIII-59 | —H | H | 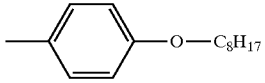 | 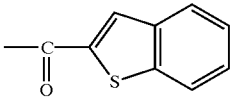 | Cl |
| VIII-60 | $—C_2H_5$ | H | 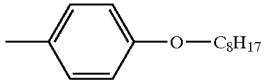 | 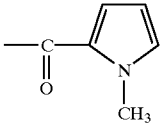 | Cl |

Cyan couples of formula (VIII) are produced by the procedure given in U.S. Pat. No. 5,686,235.
Examples of magenta couplers of formula (V) include:
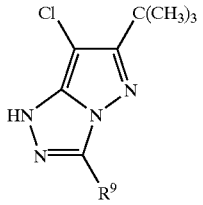
| Coupler | $R^9$ |
|---|---|
| V-1 | $—C_{13}H_{27}$ |
| V-2 | $—(CH_2)_3SO_2C_{12}H_{25}$ |
| V-3 | 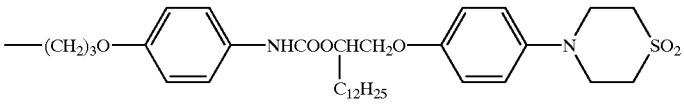 |
| V-4 | 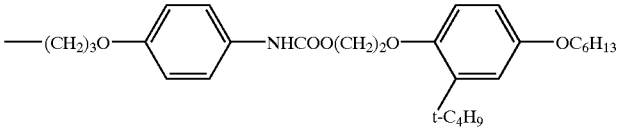 |
| V-5 | 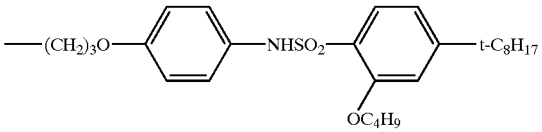 |
| V-6 | 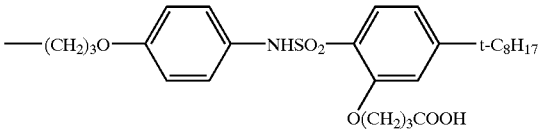 |
| V-7 | $—(CH_2)_2NHCOC_{13}H_{27}$ |
| V-8 | 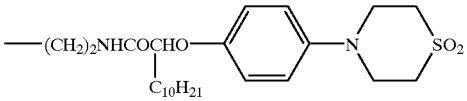 |
| V-9 | 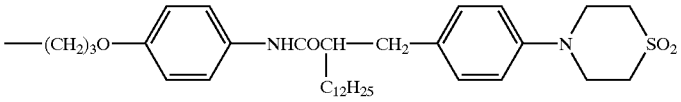 |
| V-10 | 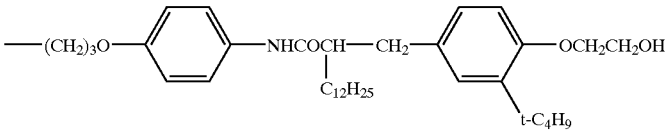 |
| V-11 | 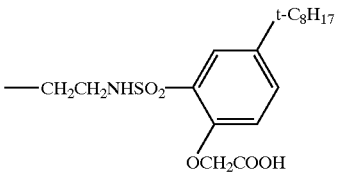 |
| V-12 | $—CH_2CH_2NHSO_2C_{16}H_{33}$ |

-continued
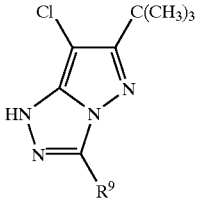
| Coupler | $R^9$ |
|---|---|
| V-13 | $—CH_2CH_2NHCONHC_{12}H_{25}$ |
| V-14 | $—(CH_2)_3NHSO_2C_{12}H_{25}$ |
| V-15 | 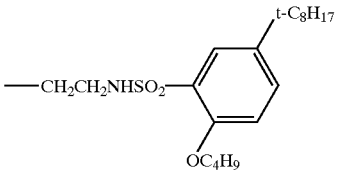 |
| V-16 | 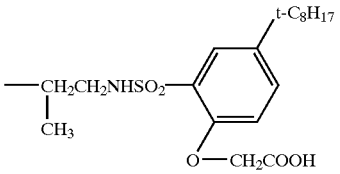 |
| V-17 | 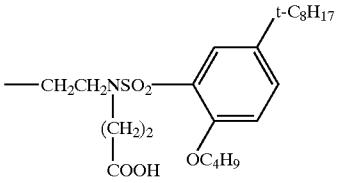 |
| V-18 | 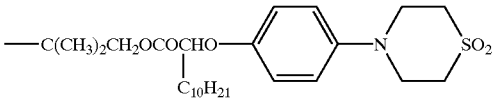 |
| V-19 | 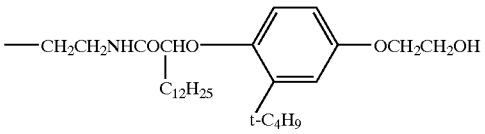 |
| V-20 | 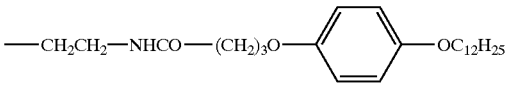 |
| V-21 | $—CH_2CH_2NHCOOC_{12}H_{25}$ |
| as well as | |
| V-22 | 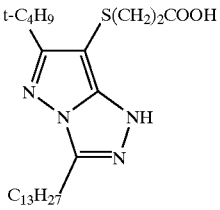 |

-continued
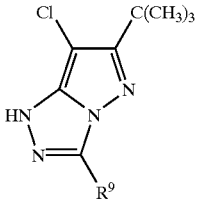
| Coupler | $R^9$ |
|---|---|
| V-23 | 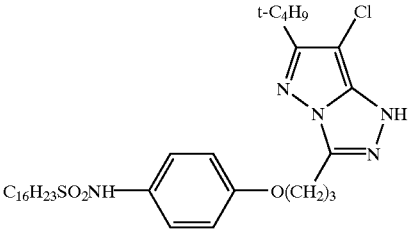 |
| V-24 | 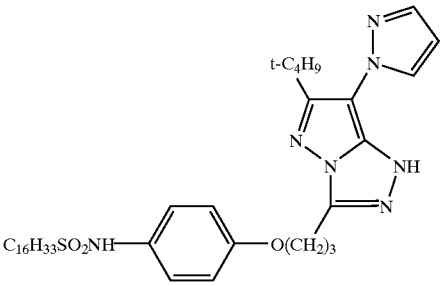 |
| V-25 | 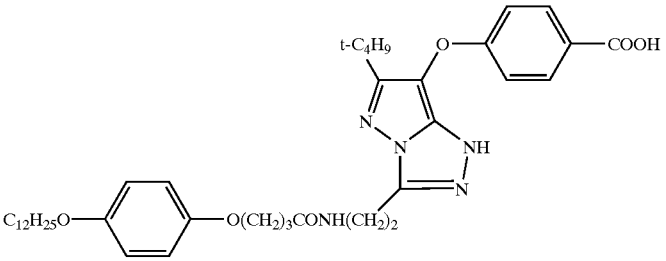 |
Examples of magenta couplers of formula (VI) include:
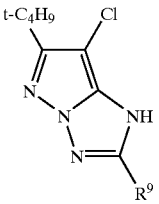
| Coupler | $R^9$ |
|---|---|
| VI-1 | 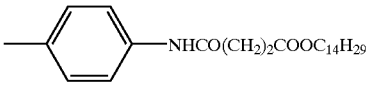 |

-continued
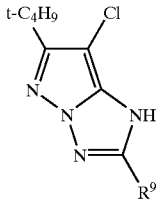
| Coupler | $R^9$ |
|---|---|
| VI-2 | 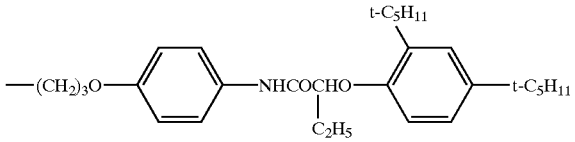 |
| VI-3 | 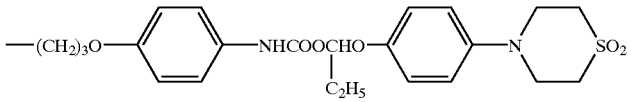 |
| VI-4 | 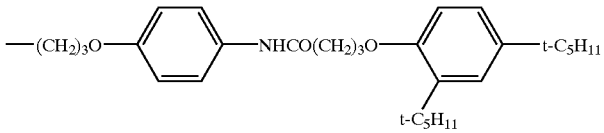 |
| VI-5 | 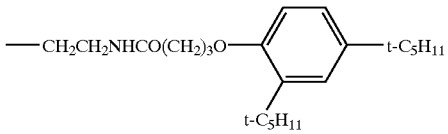 |
| VI-6 | 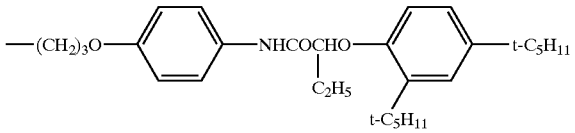 |
| VI-7 | 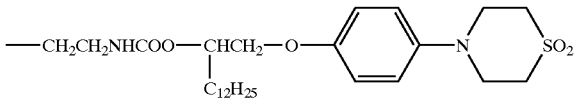 |
| VI-8 | 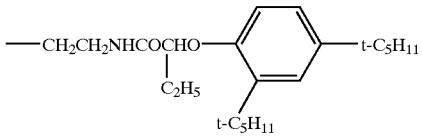 |
| VI-9 | $—CH_2CH_2NHCOC_{13}H_{27}$ |
| VI-10 | 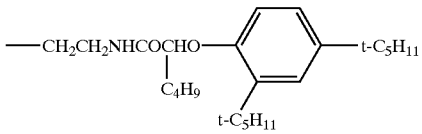 |
| VI-11 | $—(CH_2)_3SO_2C_{12}H_{25}$ |

-continued
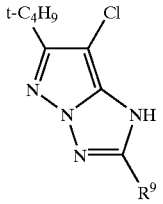
Coupler $R^9$
VI-12
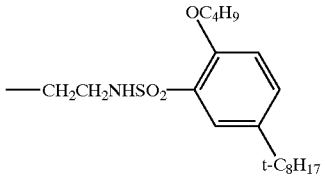
VI-13
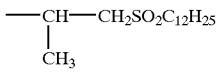
VI-14
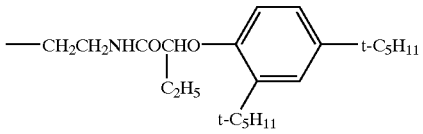
VI-15
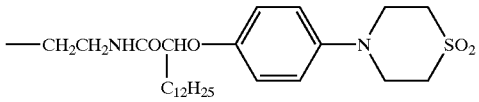
VI-16
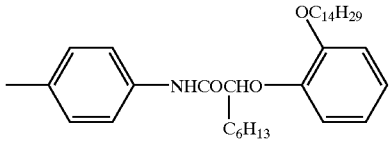
VI-17
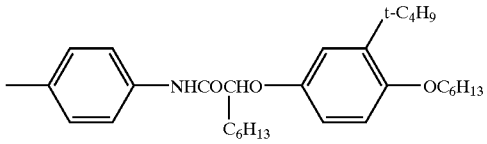
VI-18
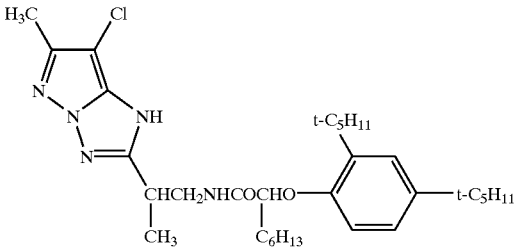

-continued
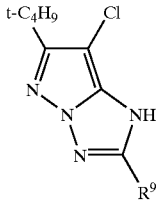
| Coupler | $R^9$ |
|---|---|
| VI-19 | 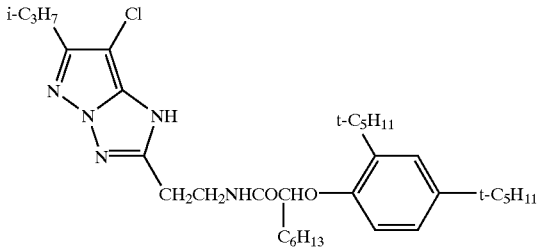 |
| VI-20 | 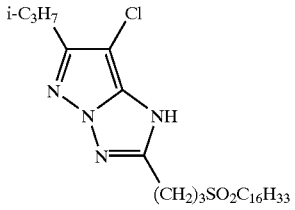 |
| VI-21 | 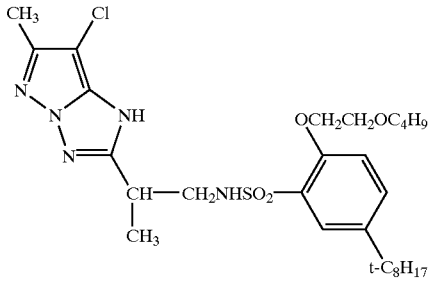 |
| VI-22 | 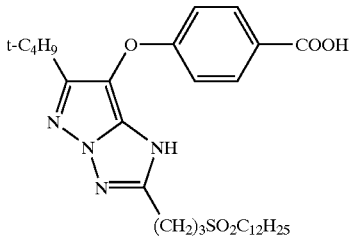 |
| VI-23 | 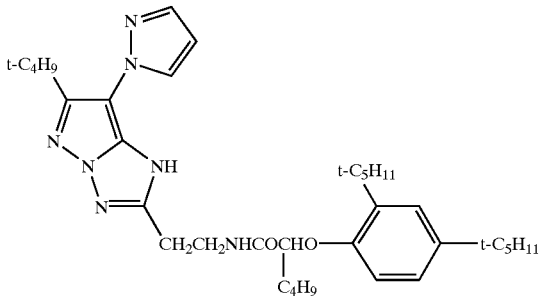 |

-continued
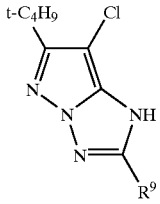
| Coupler | $R^9$ |
|---|---|
| VI-24 | 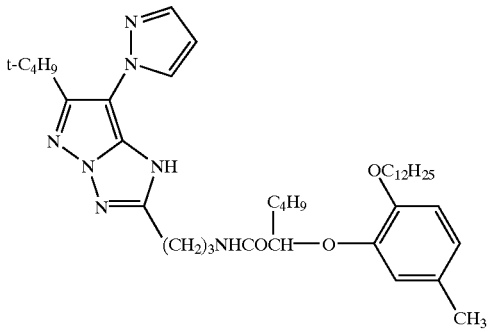 |
Examples of yellow couplers of formula (IV) include:
IV-1
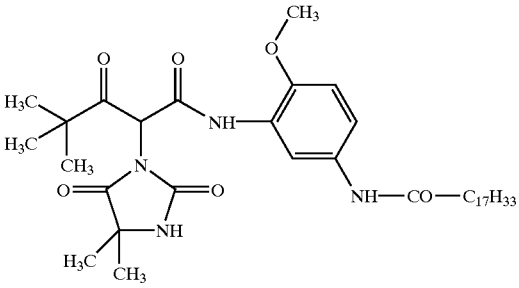
IV-2
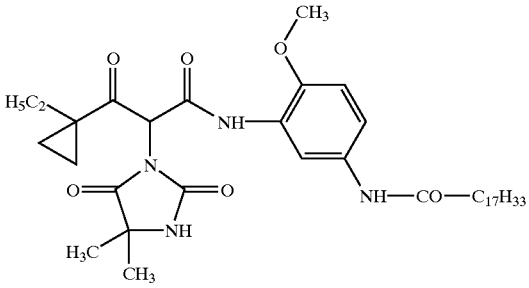
IV-3
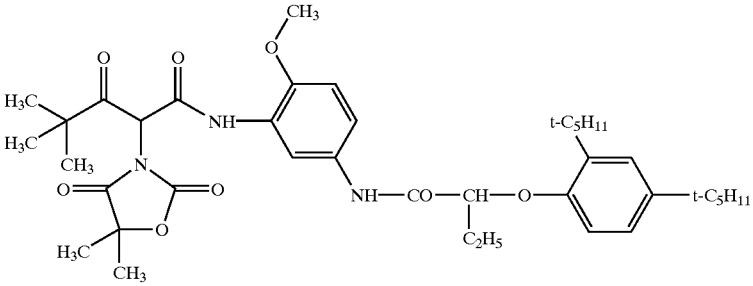
IV-4
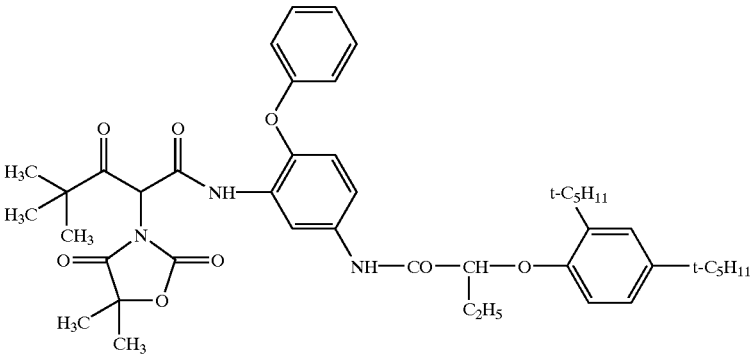

-continued
IV-5
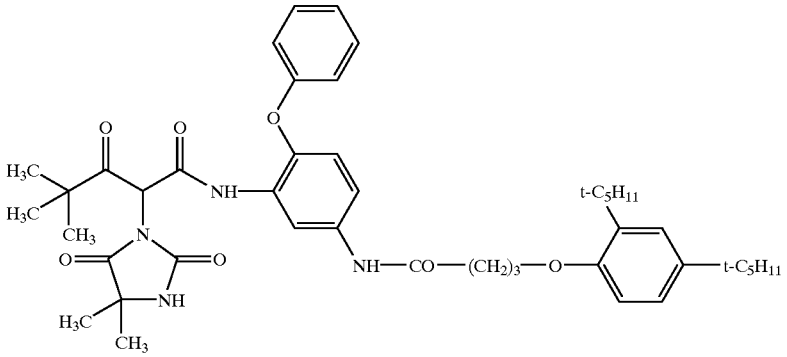
IV-6
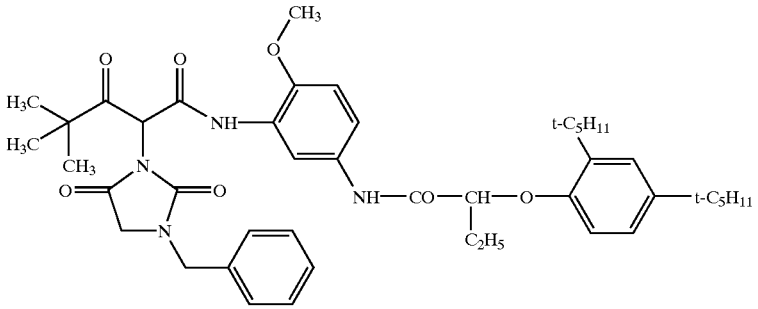
IV-7
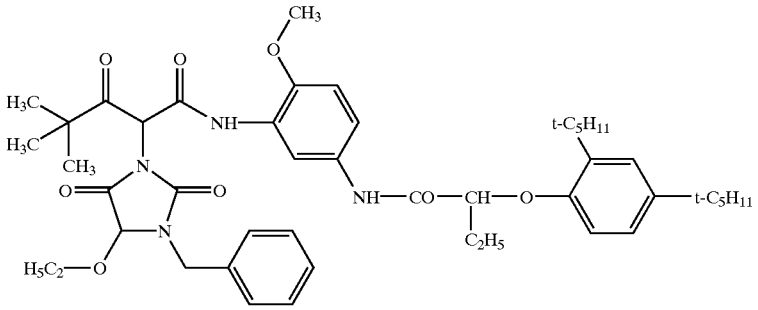
IV-8
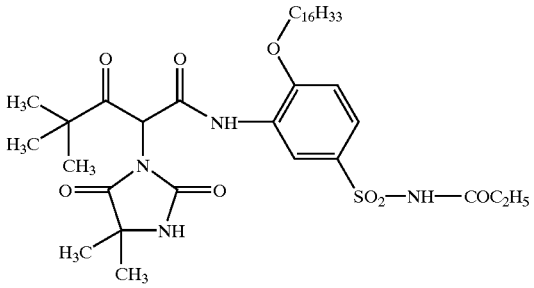
IV-9
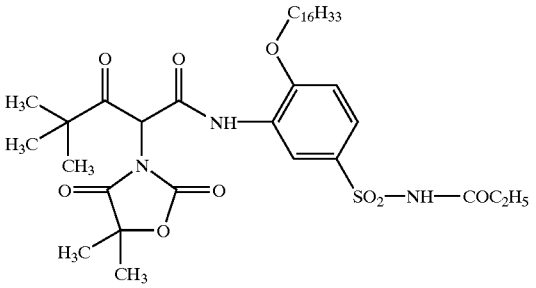
IV-10
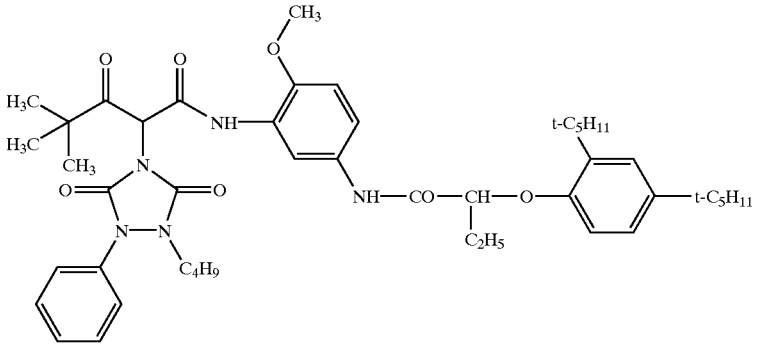

-continued
IV-11
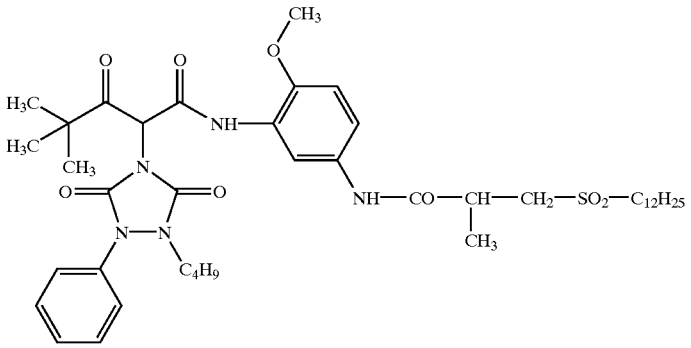
IV-12
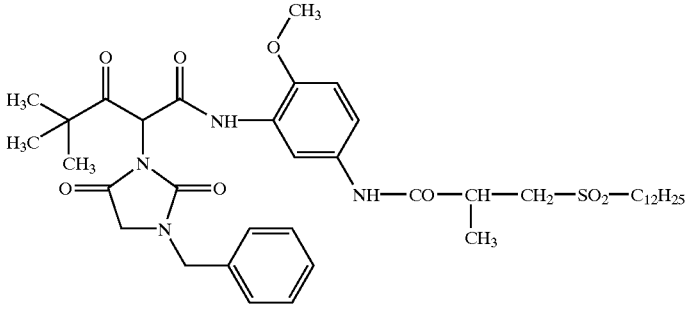
IV-13
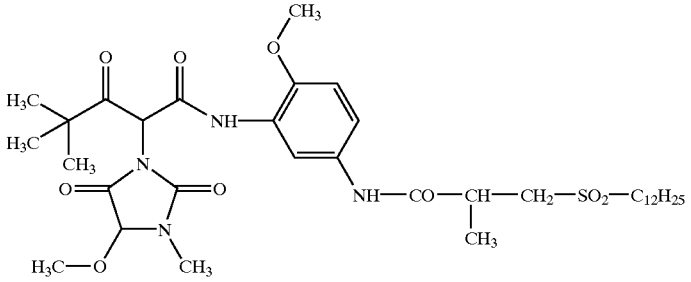
IV-14
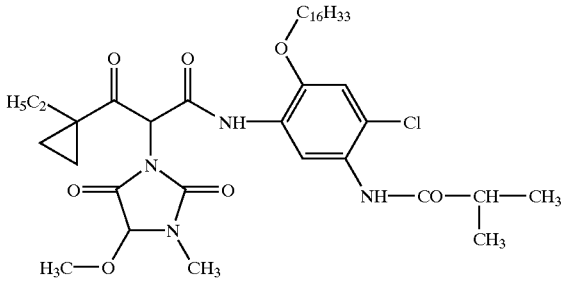
IV-15
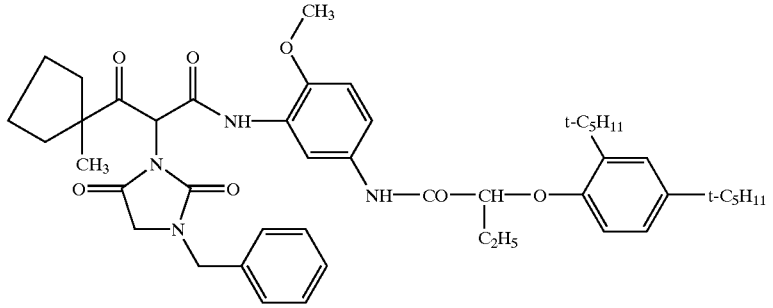

-continued
IV-16
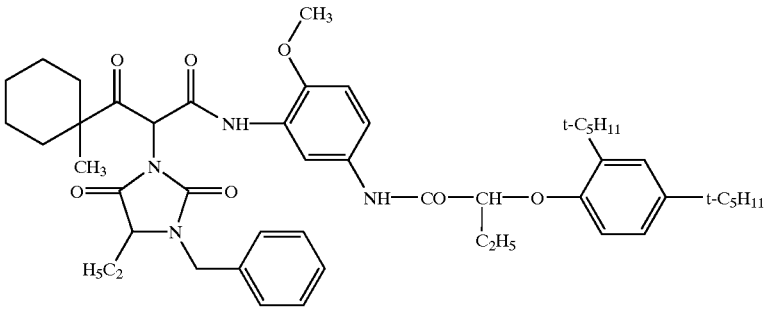
IV-17
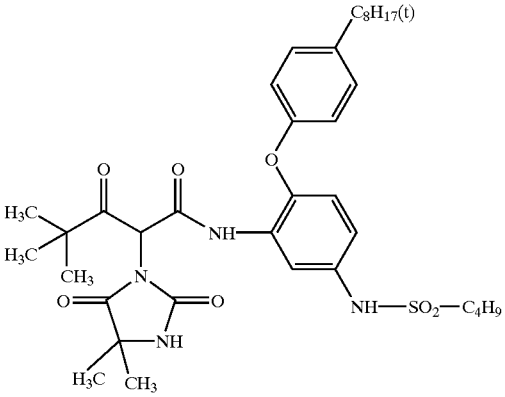
IV-18
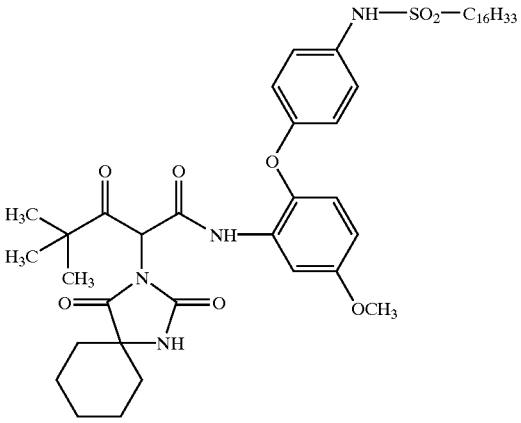
IV-19
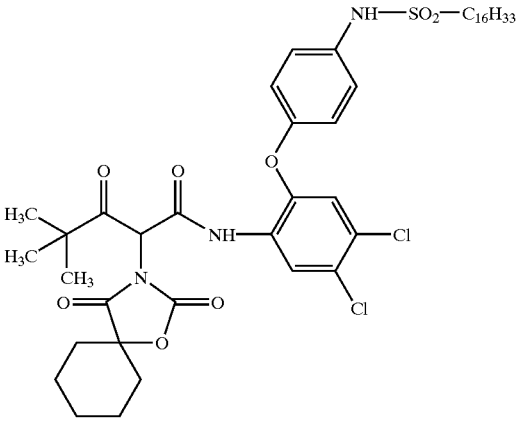
IV-20
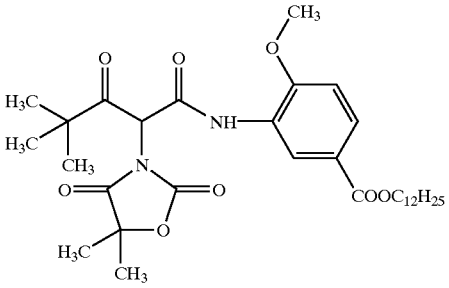
IV-21
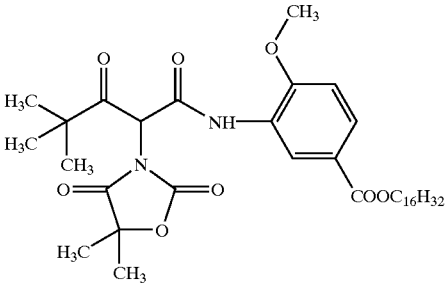
IV-22
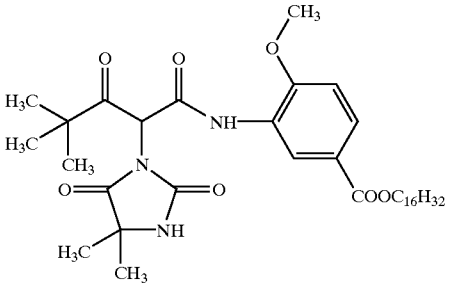

-continued
IV-23
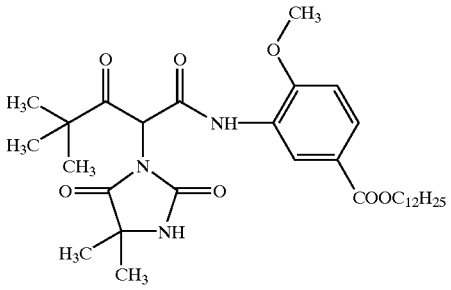
IV-24
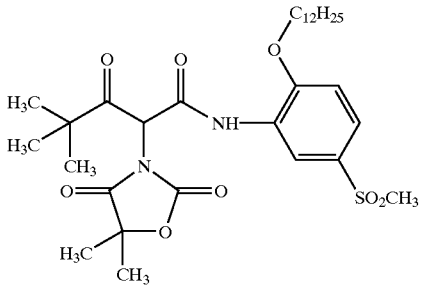
IV-25
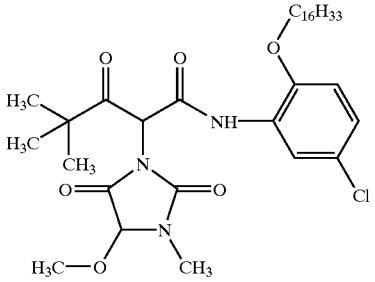
IV-26
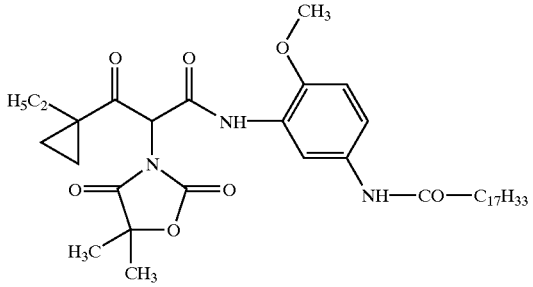
IV-27
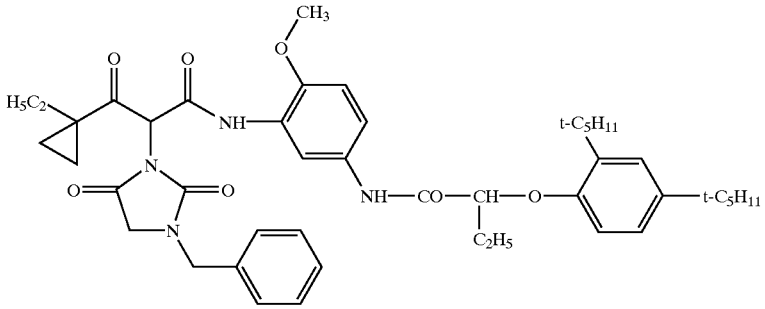
IV-28
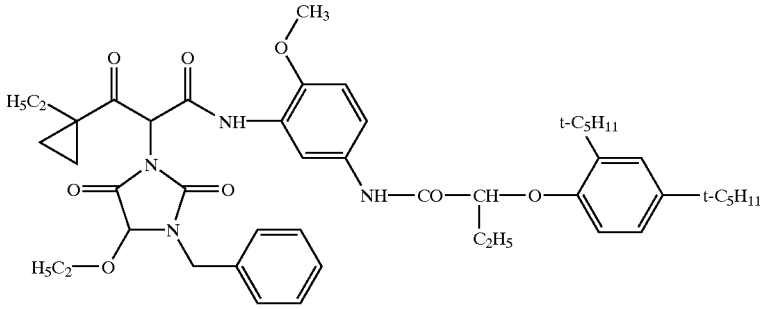
IV-29
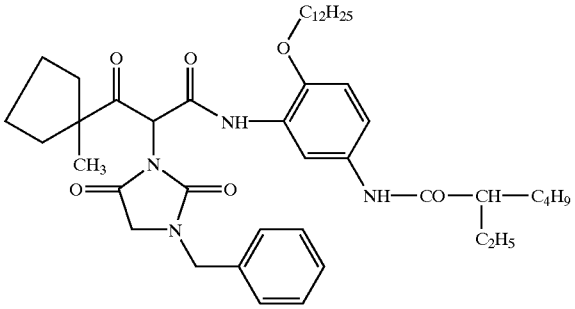

-continued
IV-30
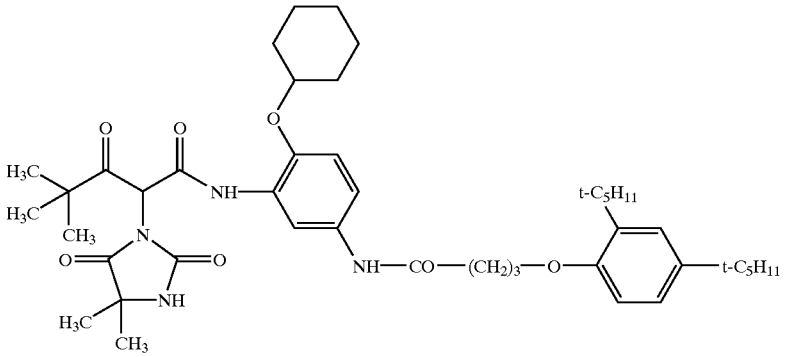
IV-31
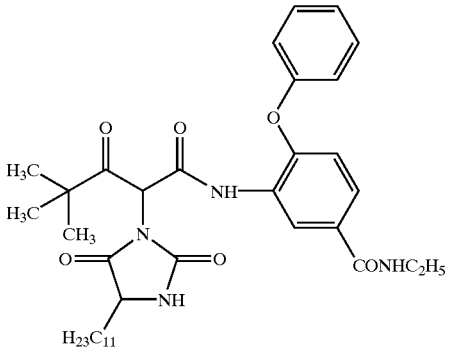
IV-32
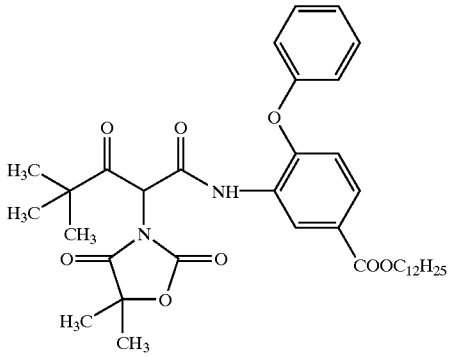
IV-33
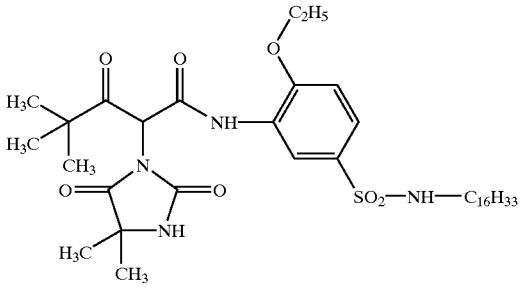
IV-34
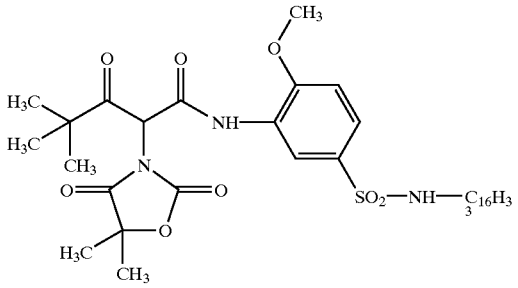
IV-35
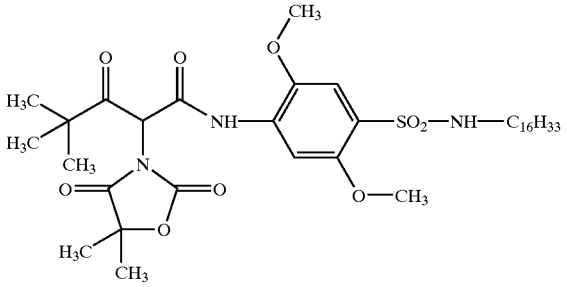
IV-36
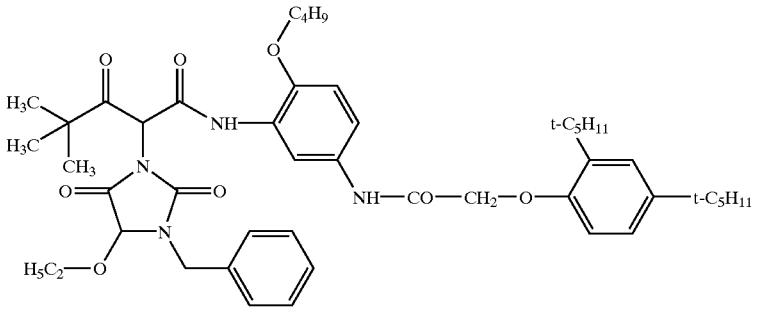

-continued
IV-37
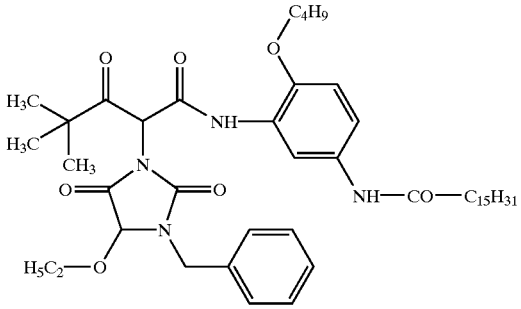
IV-38
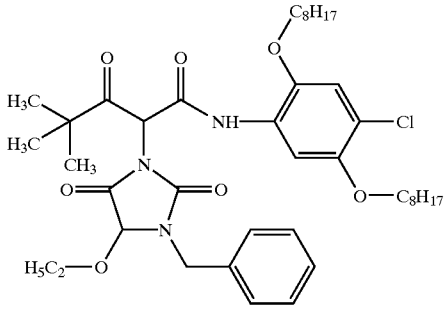
IV-39
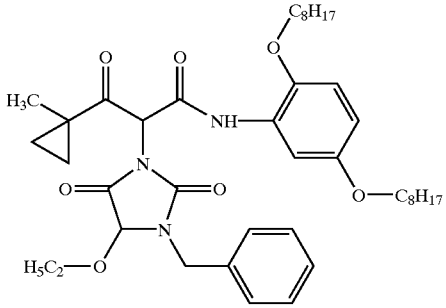
IV-40
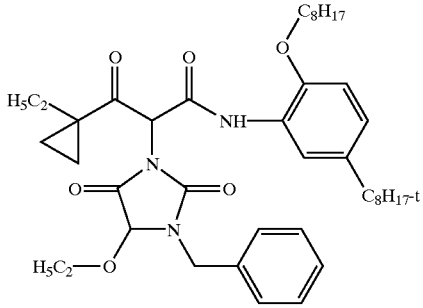
IV-41
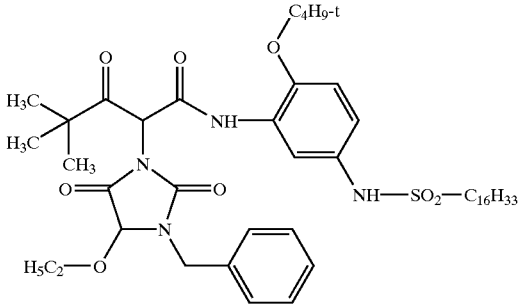
IV-42
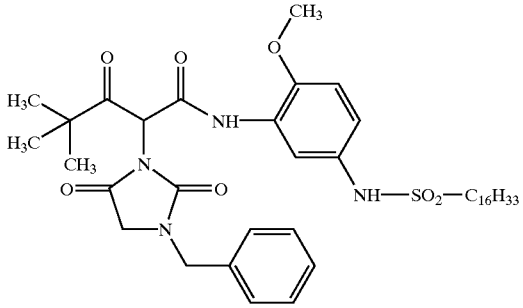
IV-43
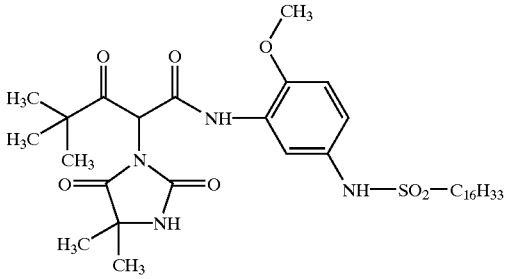
IV-44
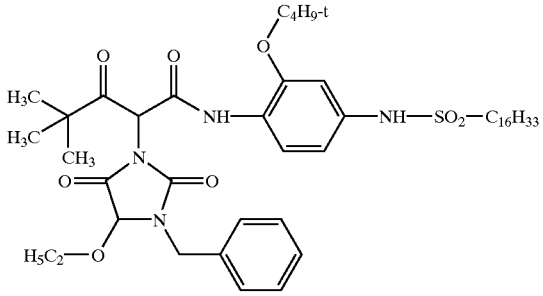
IV-45
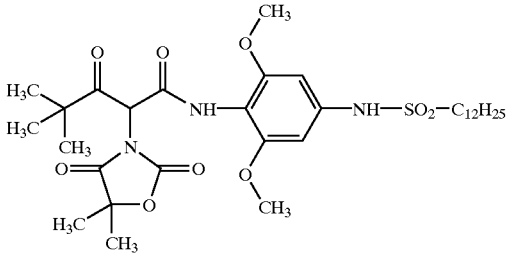
IV-46
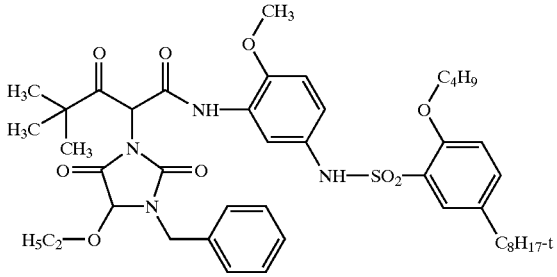

-continued
IV-47
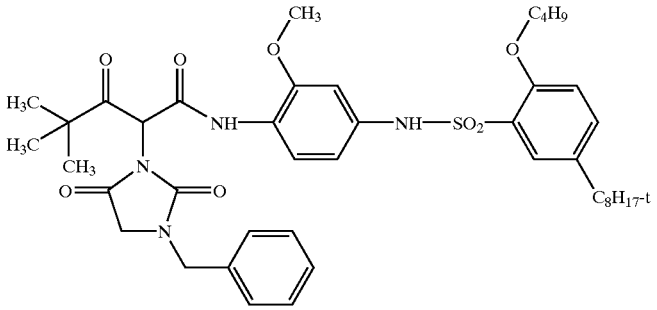
IV-48
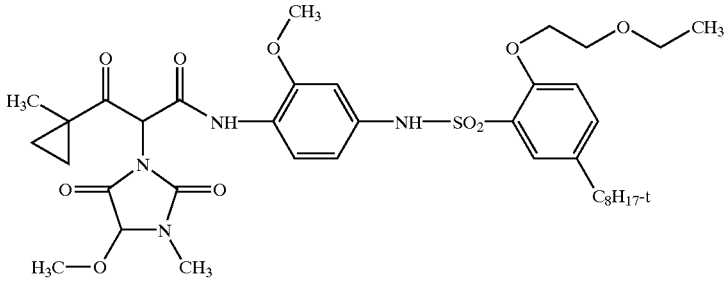
IV-49
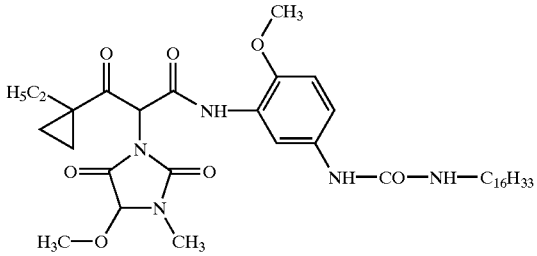
IV-50
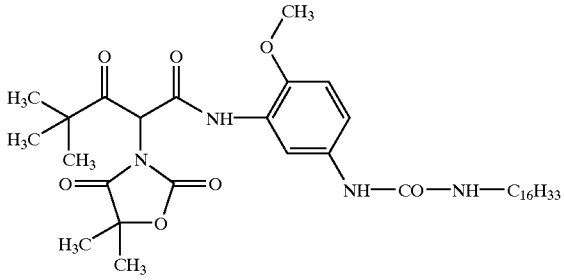
IV-51
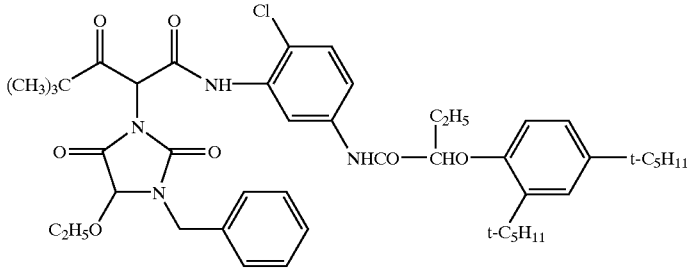
IV-52
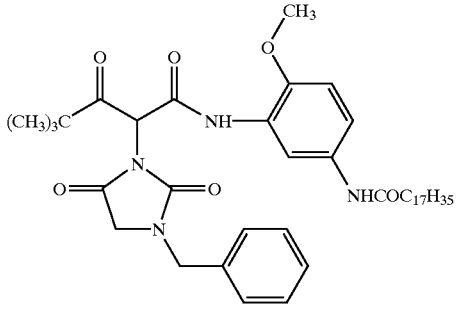
IV-53
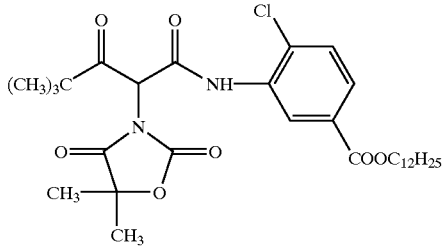

-continued

IV-54

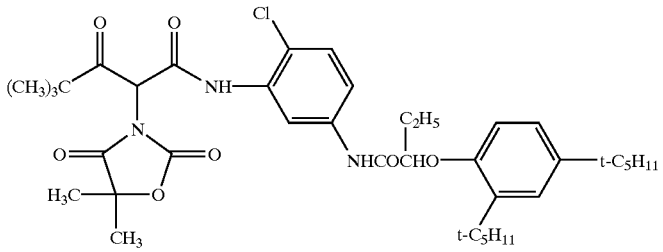

Compounds of formula IX are used in particular as blue sensitisers (IX)

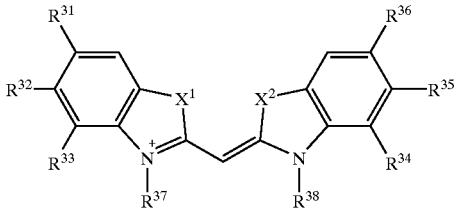

M wherein $X^1$ and $X^2$ independently of each other, denote S or Se, $R^{31}$ to $R^{36}$ independently of each other, denote a hydrogen atom or a halogen atom, an alkyl, alkoxy, aryl or hetaryl group, or $R^{31}$ and $R^{32}$ or $R^{32}$ and $R^{33}$, $R^{34}$ and $R^{35}$ or $R^{35}$ and $R^{36}$ denote the remaining members of a condensed-on benzene, naphthalene or heterocyclic ring, $R^{37}$ and $R^{38}$ independently of each other, denote an alkyl, sulphoalkyl, carboxyalkyl, —$(CH_2)_1SO_2R^{39}SO_2$-alkyl, —$(CH_2)_1SO_2R^{39}CO$-alkyl, —$(CH_2)_1COR^{39}SO_2$-alkyl or —$(CH_2)_1$—$COR^{39}CO$-alkyl group, $R^{39}$ denotes —N— or —NH—, l denotes an integer from 1 to 6, and M denotes a counterion which may be necessary for charge equalisation.

$R^{31}$ to $R^{36}$, independently of each other, preferably denote H, alkyl, F, Cl, Br, $CF_3$, $OCH_3$, phenyl, or $R^{31}$ and $R^{32}$ or $R^{32}$ and $R^{33}$, $R^{34}$ and $R^{35}$ or $R^{35}$ and $R^{36}$ denote the remaining members of a condensed-on benzene or naphthalene ring.

Examples of suitable blue sensitisers include the following compounds, wherein "Et" represents ethyl:

IX-1

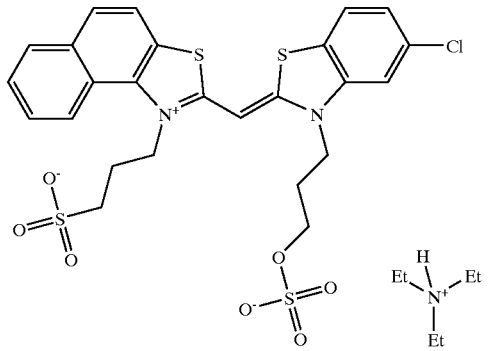

-continued

IV-2

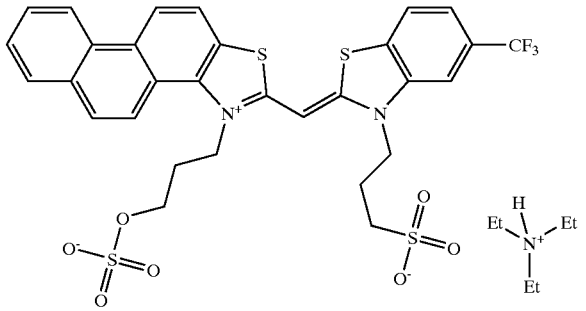

IX-3

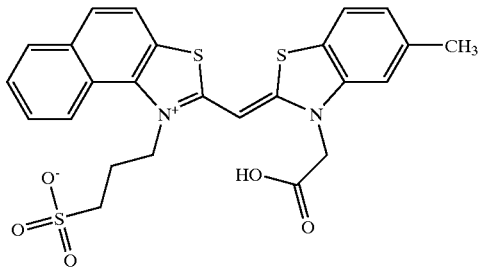

IX-4

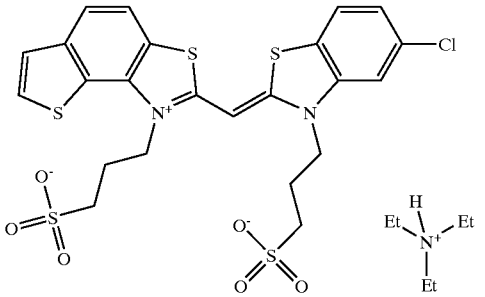

IX-5

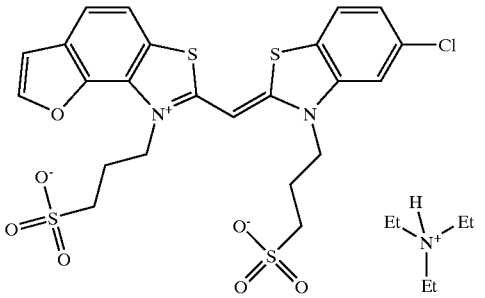

-continued
IX-6
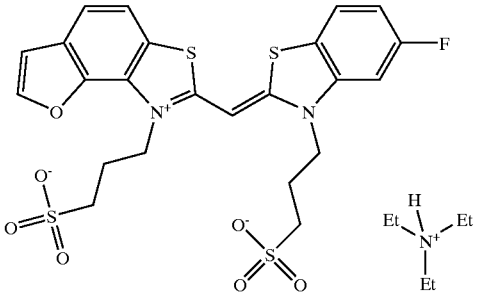
IX-7
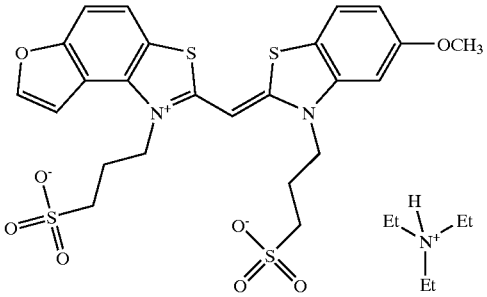
IX-8
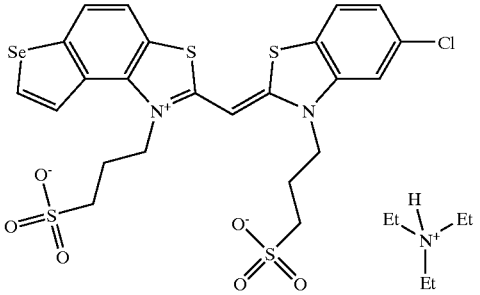
IX-9
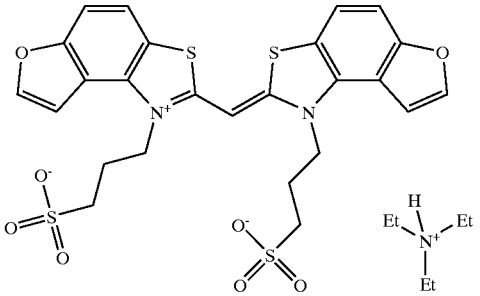
IX-10
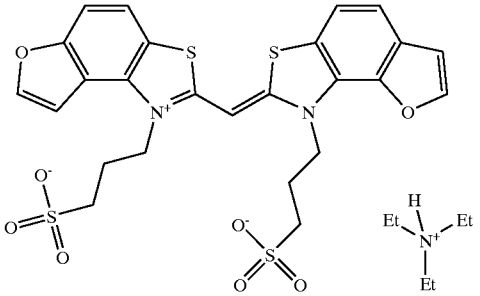
-continued
IX-11
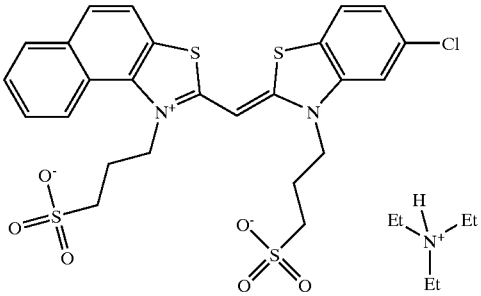
IX-12
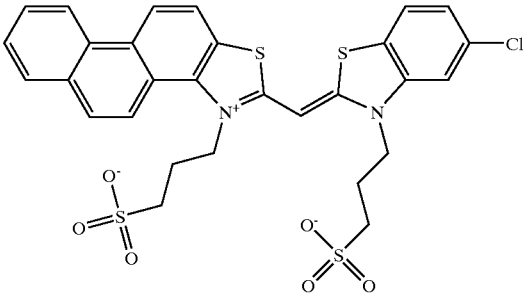
IX-13
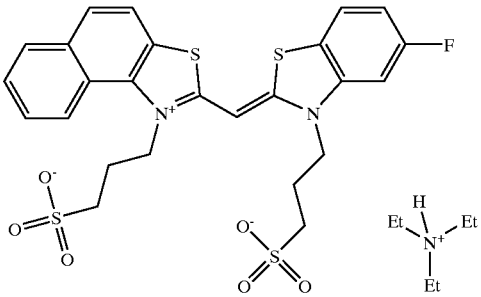
IX-14
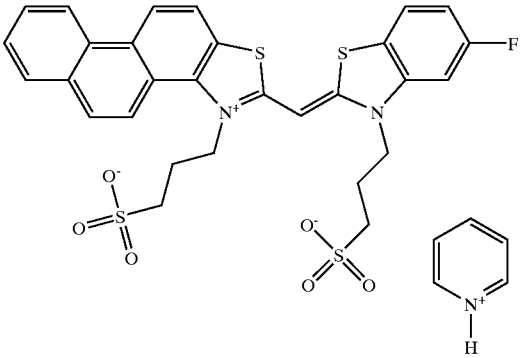
IX-15
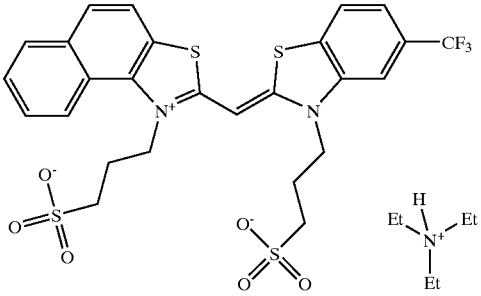

-continued
IX-16
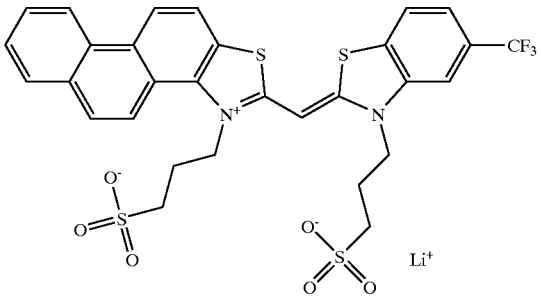
IX-17
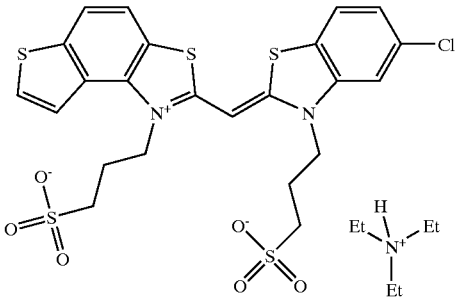
IX-18
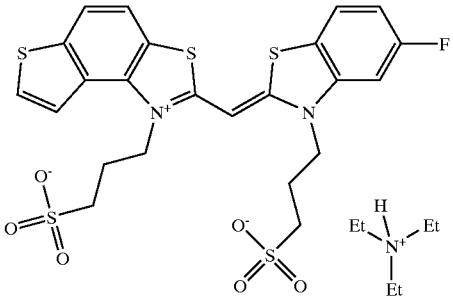
IX-19
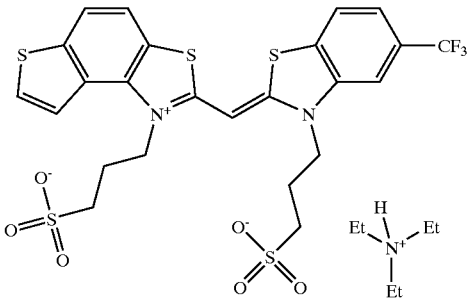
IX-20
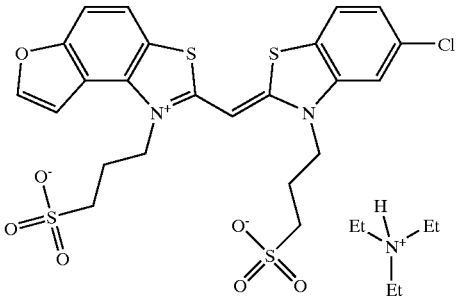
-continued
IX-21
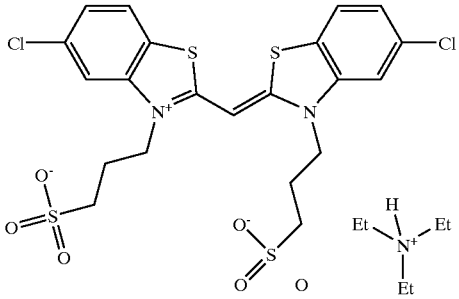
IX-22
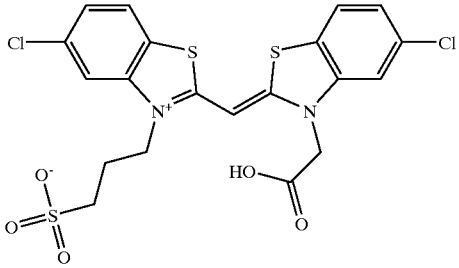
IX-23
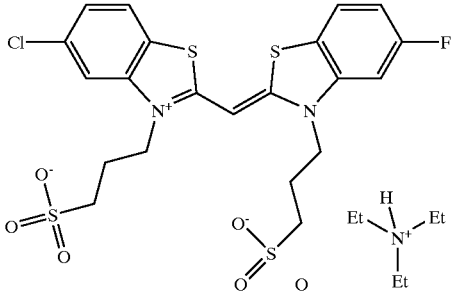
IX-24
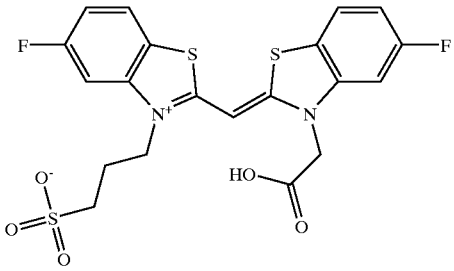
IX-25
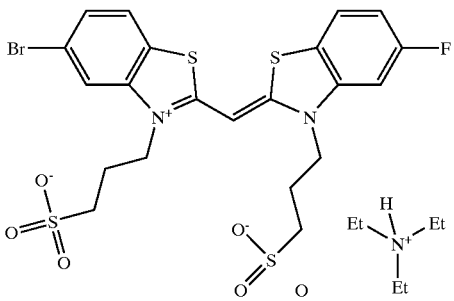

-continued
IX-26
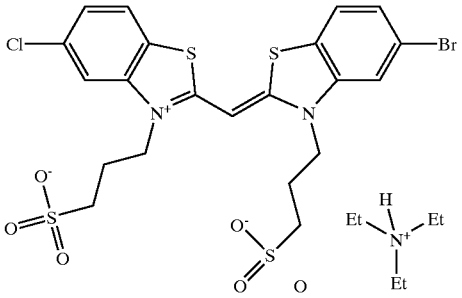
IX-27
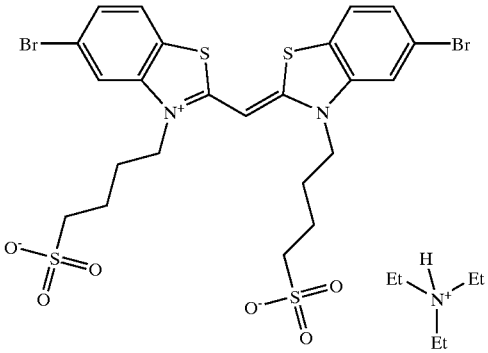
IX-28
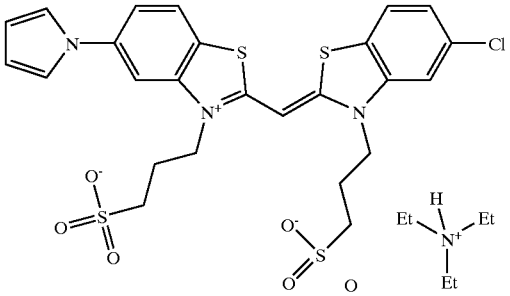
IX-29
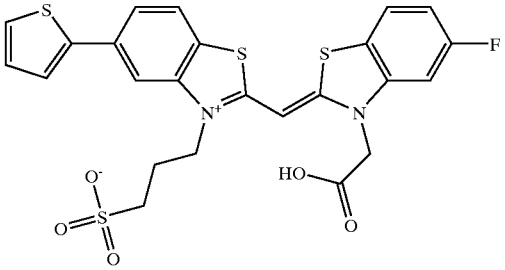
IX-30
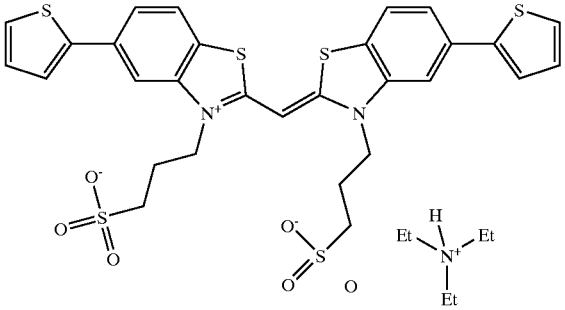
-continued
IX-31
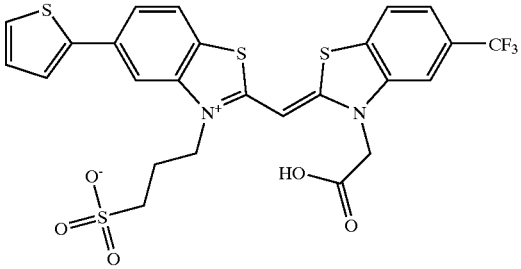
IX-32
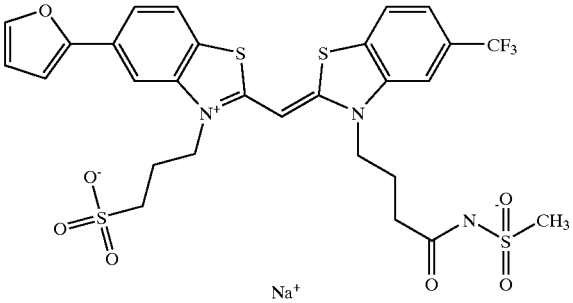
IX-33
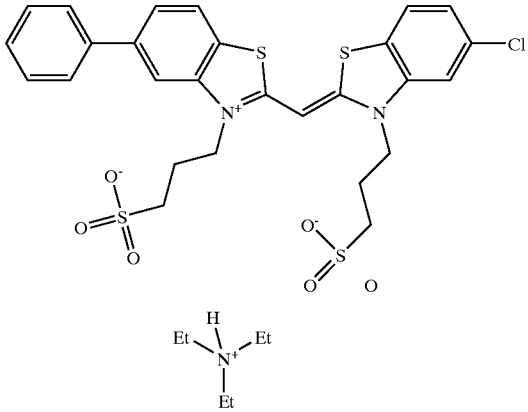
IX-34
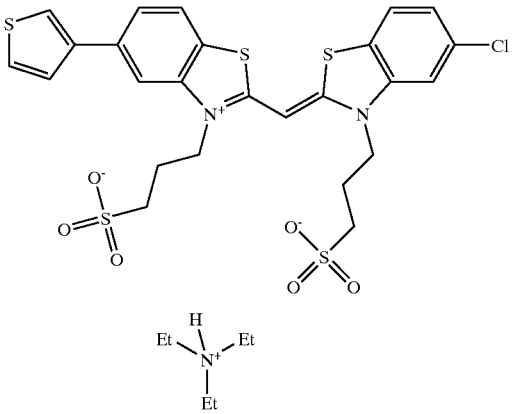

Suitable red sensitisers correspond to general formulae X or XI (X)

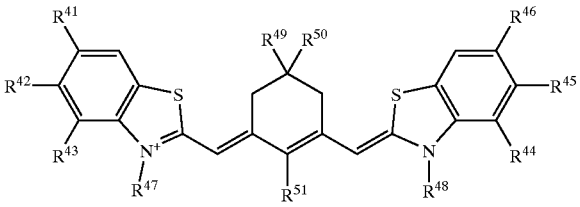

M (XI)

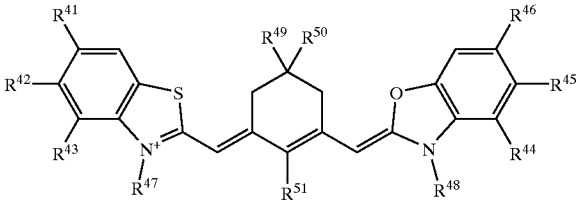

M wherein $R^{41}$ to $R^{46}$, independently of each other, have the same meanings as $R^{31}$ to $R^{36}$, $R^{47}$ and $R^{48}$, independently of each other, have the same meanings as $R^{37}$ and $R^{38}$, $R^{49}$ and $R^{50}$, independently of each other, denote a hydrogen atom or an alkyl or aryl group, $R^{51}$ denotes a hydrogen atom, a halogen atom or an alkyl group, and M denotes a counterion which may be necessary for charge equalisation.

Examples of red sensitisers are listed below, wherein "Et" represents ethyl:

X-1

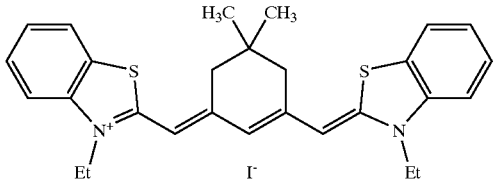

X-2

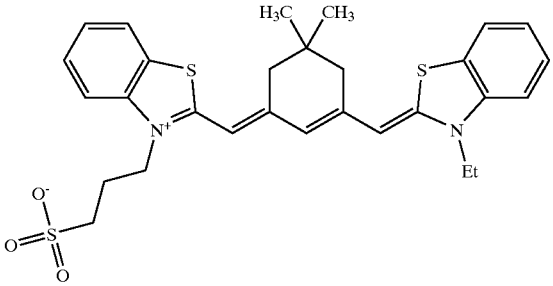

X-3

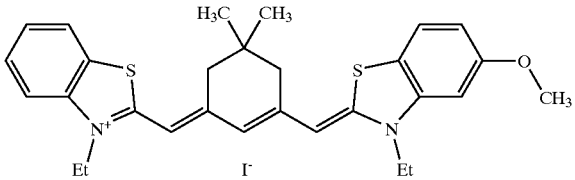

-continued

X-4

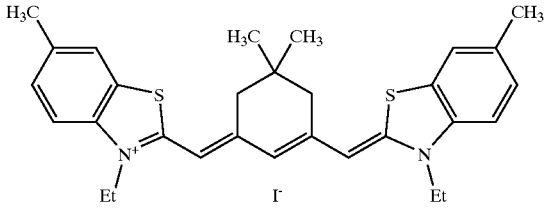

X-5

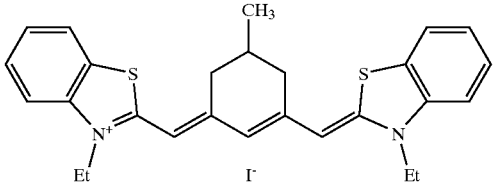

X-6

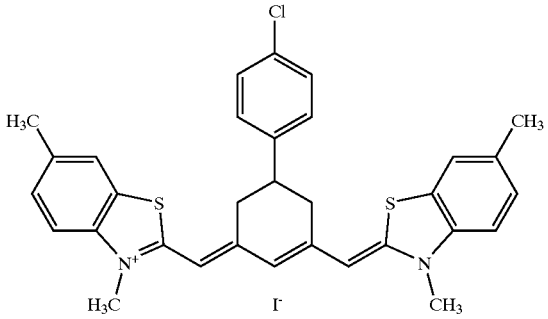

X-7

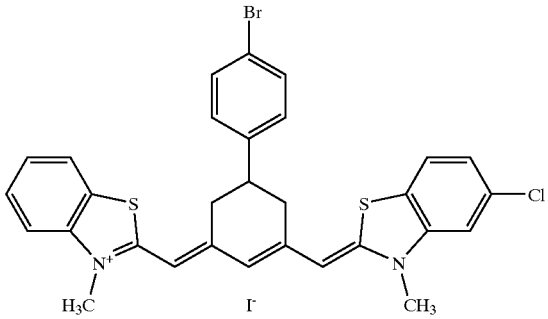

X-8

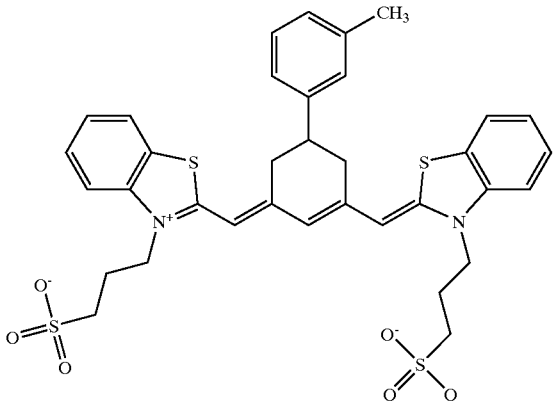

-continued
X-9
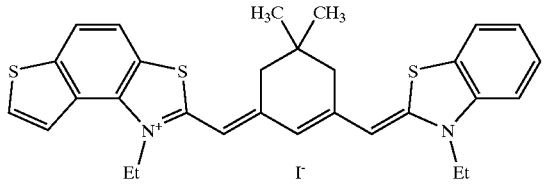
X-10
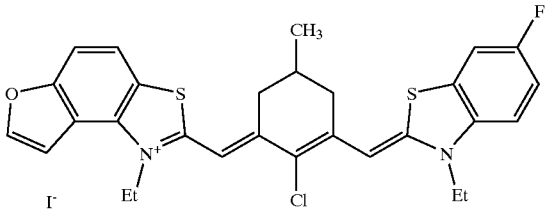
X-11
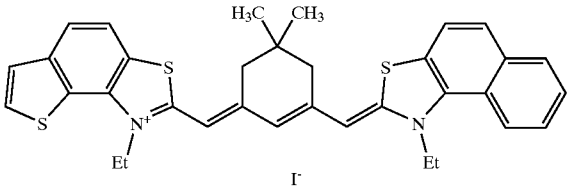
X-12
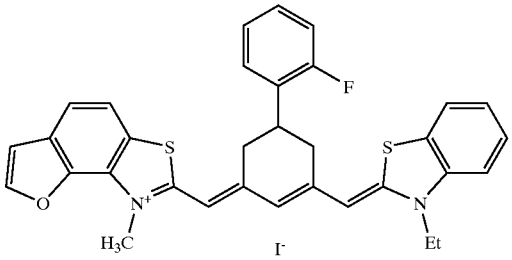
X-13
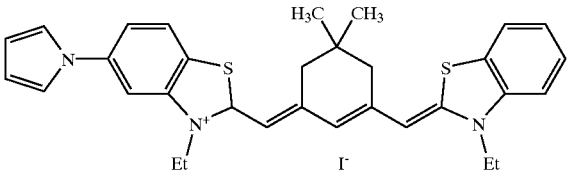
X-14
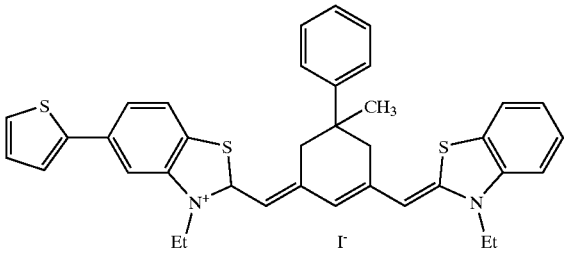
X-15
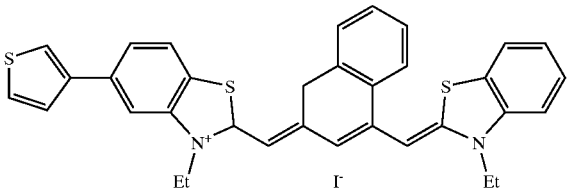
-continued
X-16
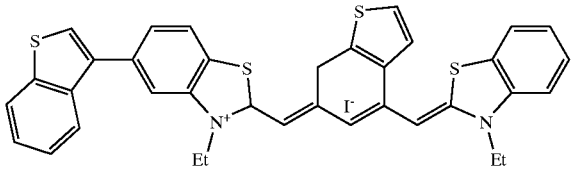
X-17
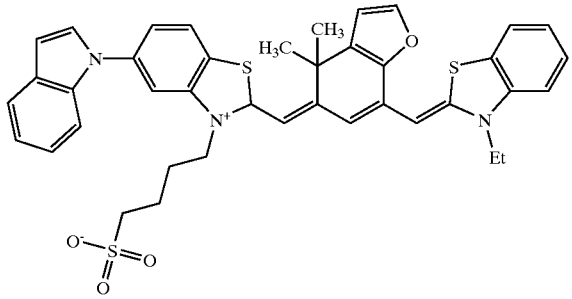
X-18
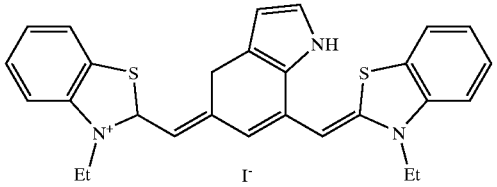
X-19
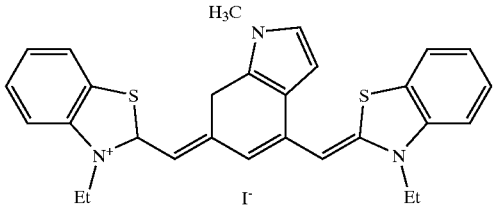
X-20
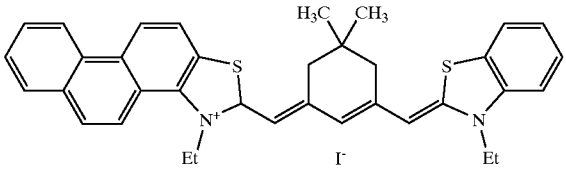
XI-1
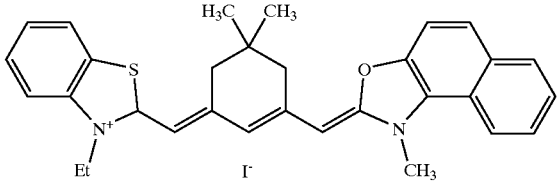
XI-2
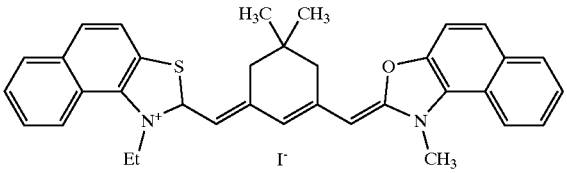

-continued
XI-3
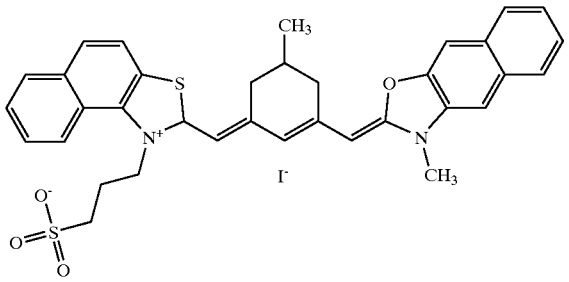
XI-4
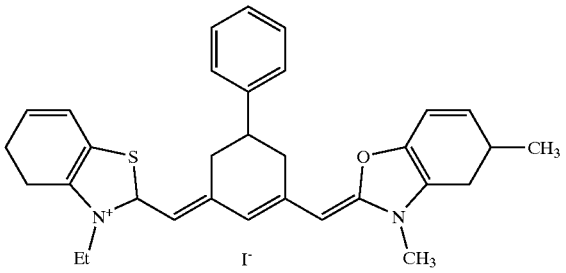
XI-5
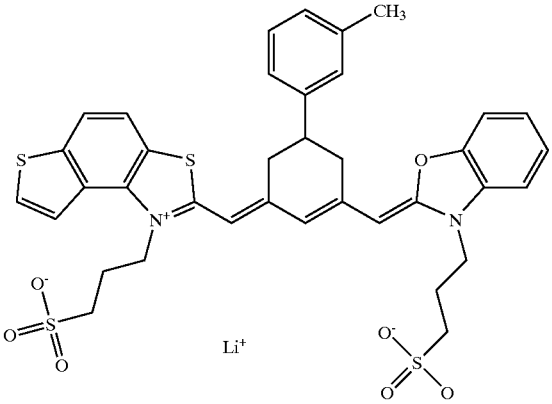
XI-6
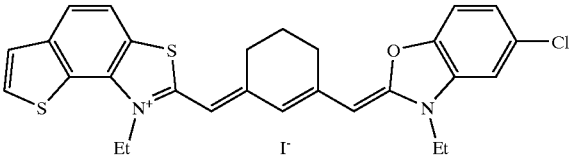
XI-7
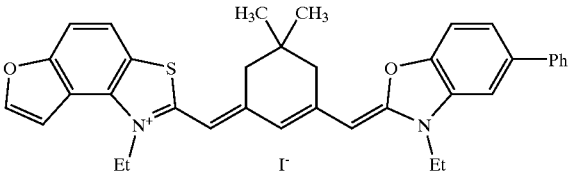
XI-8
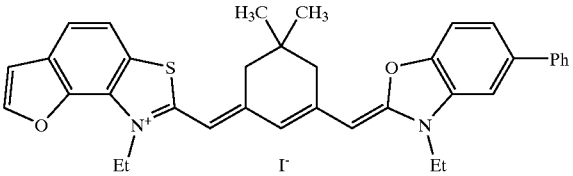
-continued
XI-9
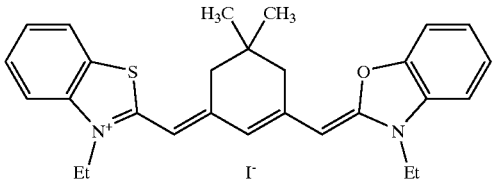
XI-10
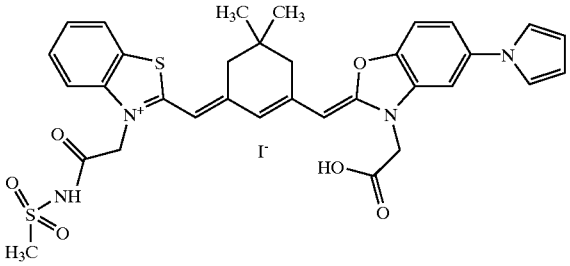
XI-11
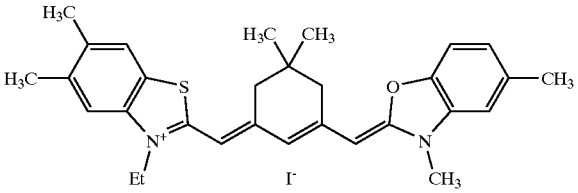
XI-12
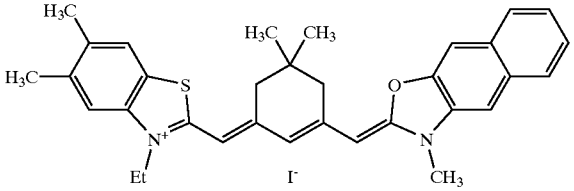
XI-13
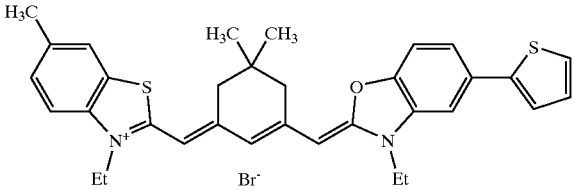
XI-14
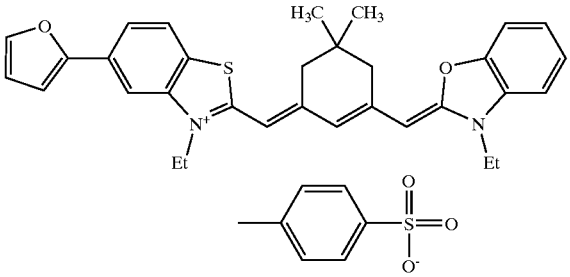
XI-15
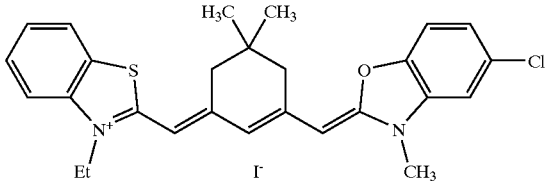

-continued

XI-16

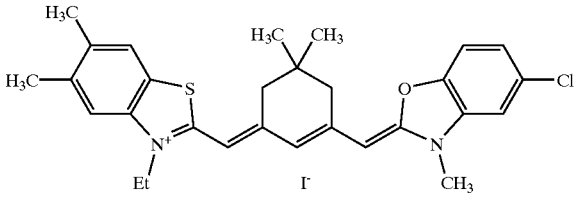

XI-17

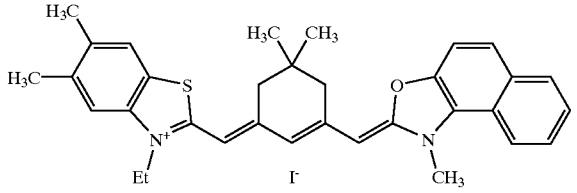

XI-18

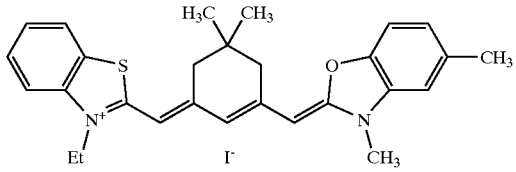

XI-19

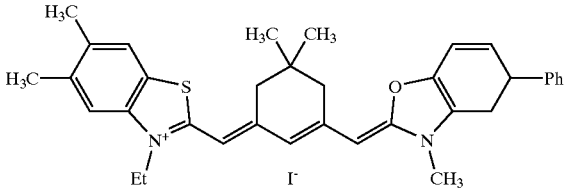

XI-20

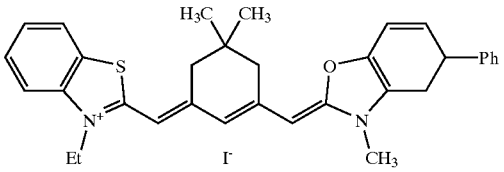

XI-21

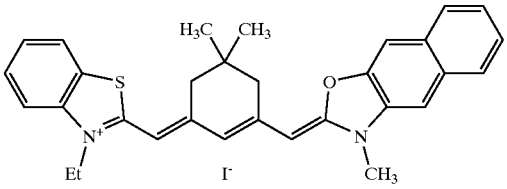

XI-22

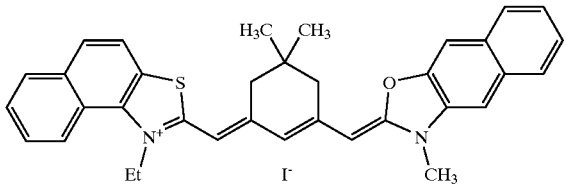

-continued

XI-23

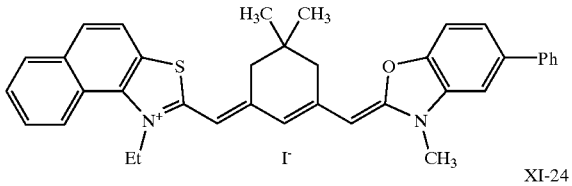

XI-24

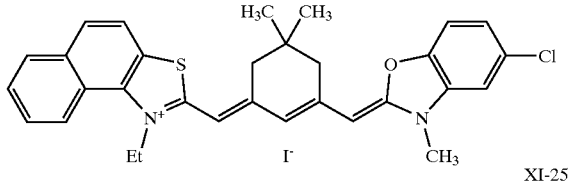

XI-25

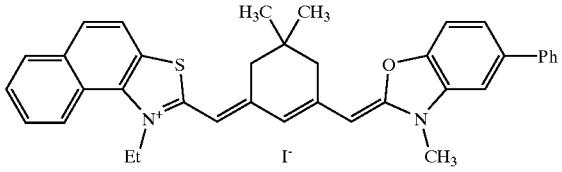

Other preferred embodiments of the invention are given in the subsidiary claims.

The photographic material is preferably a color print material.

Photographic color print materials consist of a support on which at least one light-sensitive silver halide emulsion layer is deposited. Thin films and foils are particularly suitable as supports, as is paper which is coated with polyethylene or with polyethylene terephthalate. A review of support materials and of the auxiliary layers which are deposited on the front and back thereof is given in Research Disclosure 37254, Part 1 (1995), page 285.

Color photographic color print materials usually contain, in the following sequence on their support, at least one blue-sensitive, yellow-coupling silver halide emulsion layer, at least one green-sensitive, magenta-coupling silver halide emulsion layer, and at least one red-sensitive, cyan-coupling silver halide emulsion layer. These layers can be interchanged with each other.

The essential constituents of the photographic emulsion layer are binders, silver halide grains and color couplers.

Information on suitable binders is given in Research Disclosure 37254, Part 2 (1995), page 286.

Information on suitable silver halide emulsions, their production, ripening, stabilisation and spectral sensitisation, including suitable spectral sensitisers, is given in Research Disclosure 37254, Part 3 (1995), page 286, and in Research Disclosure 37038, Part XV (1995), page 89.

Precipitation can also be conducted in the presence of sensitising dyes. Complexing agents and/or dyes can be made ineffective at any desired point in time, e.g. by altering the pH or by an oxidising treatment.

Information on color couplers is to be found in Research Disclosure 37254, Part 4 (1995), page 288, and in Research Disclosure 37038, Part II (1995), page 80. The maximum absorption of the dyes formed from the couplers and from the color developer oxidation product preferably falls within the following ranges: yellow couplers 430 to 460 nm, magenta couplers 540 to 560 nm, cyan couplers 630 to 700 nm.

The color couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, and in Research Disclosure 37038, Part III (1995), page 84.

The photographic material may additionally contain compounds which absorb UV light, brighteners, spacers, filter dyes, formalin scavengers, light stabilisers, anti-oxidants, $D_{Min}$ dyes, additives for improving the dye-, coupler- and white stability and to reduce color fogging, plasticisers (latices), biocides and other substances.

Suitable compounds are given in Research Disclosure 37254, Part 8 (1995), page 292, and in Research Disclosure 37038, Parts IV, V, VI, VII, X, XI and XIII (1995), pages 84 et seq.

The layers of color photographic materials are usually hardened, i.e. the binder used, preferably gelatine, is crosslinked by suitable chemical methods.

Instant or rapid hardeners are preferably used. Instant or rapid hardeners are to be understood as compounds which crosslink gelatine so that immediately after coating, or no later than a few days after coating, hardening has proceeded to such an extent that there is no further change in sensitometry and in the swelling of the layer composite due to the crosslinking reaction. Swelling is to be understood as the difference between the wet film density and the dry film density during the aqueous processing of the material.

Suitable rapid and instant hardener substances are described in Research Disclosure 37254, Part 9 (1995), page 294, and in Research Disclosure 37038, Part XII (1995), page 86.

After image-by-image exposure, color photographic materials are processed by different methods corresponding to their character. Details on the procedures used and the chemicals required therefor are published in Research Disclosure 37254, Part 10 (1995), page 294, and in Research Disclosure 37038, Parts XVI to XXIII (1995), page 95 et seq., together with examples of materials. The color photographic material according to the invention is particularly suitable for rapid processing with development times of 10 to 30 seconds.

Halogen lamps or laser illumination devices are particularly suitable as light sources for exposure.

Production of Silver Halide Emulsions

Micrate Emulsion (EmM1) (Dopant-free Micrate Emulsion)

The following solutions were made up using demineralised water:

| | | |
|---|---|---|
| Solution 01 | 5500 g | water |
| | 700 g | gelatine |
| | 5 g | n-decanol |
| | 20 g | NaCl |
| Solution 02 | 9300 g | water |
| | 1800 g | NaCl |
| Solution 03 | 9000 g | water |
| | 5000 g | $AgNO_3$ |

Solutions 02 and 03 were added, simultaneously and with intensive stirring, to solution 01 at 40° C. over 30 minutes at a constant rate of addition at pAg 7.7 and pH 6.0. During precipitation, the pAg in the precipitation vessel was held constant by adding a NaCl solution and the pH in the precipitation vessel was held constant by adding $H_2SO_4$. An AgCl emulsion with an average particle diameter of 0.10 $\mu$m was obtained. The ratio by weight of gelatine to $AgNO_3$ (the amount of AgCl in the emulsion is converted below into $AgNO_3$) was 0.14. The emulsion was ultrafiltered at 50° C. and was redispersed with an amount of gelatine and water such that the ratio by weight of gelatine to $AgNO_3$ was 0.3 and the emulsion contained 200 g AgCl per kg. After redispersion, the grain size was 0.13 $\mu$m.

Micrate Emulsion EmM2 (Ir- and Fe-doped Micrate Emulsion)

The procedure was as for EmM1, except that 7150 $\mu$g $K_2IrCl_6$ and 21.33 mg $K_4Fe(CN)_6$ were additionally added to solution 02. The emulsion accordingly contained 500 nmol $K_2IrCl_6$ and 2500 nmol $K_4Fe(CN)_6$ per mol Ag.

Pre-precipitation for Blue-sensitive Emulsion EmB

The following solutions were made up with demineralised water:

| | | |
|---|---|---|
| Solution 11 | 5500 g | water |
| | 680 g | gelatine |
| | 5 g | n-decanol |
| | 20 g | NaCl |
| | 325 g | EmMl |
| Solution 12 | 9300 g | water |
| | 1800 g | NaCl |
| Solution 13 | 9000 g | water |
| | 5000 g | $AgNO_3$ |

Solutions 12 and 13 were added simultaneously and with intensive stirring to solution 11, which had been placed in the precipitation vessel, at 50° C. over 150 minutes at a pAg of 7.7. The pAg and pH were controlled as for the precipitation of the emulsion (EmM1). The addition was controlled so that over the first 100 minutes the flow rate of solutions 12 and 13 increased linearly from 10 ml/min to 90 ml/min; over the remaining 50 minutes a constant flow rate of 100 ml/min was employed. An AgCl emulsion with an average particle diameter of 0.70 $\mu$m was obtained. The ratio by weight of gelatine to $AgNO_3$ (the amount of AgCl in the emulsion is converted below into $AgNO_3$) was 0.14. The emulsion was ultrafiltered and was redispersed with an amount of gelatine and water such that the ratio by weight of gelatine to $AgNO_3$ was 0.56 and the emulsion contained 200 g $AgNO_3$ per kg.

Blue-Sensitive Emulsions

EmB1

4.50 kg of the pre-precipitate (corresponding to 900 g $AgNO_3$) were melted at 40° C. in a precipitation vessel. 0.5 kg micrate emulsion EmM2 (corresponding to 100 g $AgNO_3$) were melted at 40° C. a second inflow vessel equipped with a stirrer. 10 mg bisthioether 1 were added, with intensive stirring, to pre-precipitate EmV. After 5 minutes, micrate emulsion EmM2 was added at a constant rate over 25 minutes. After 10 minutes, the emulsion was redispersed with an amount of gelatine such that the ratio by weight of gelatine to $AgNO_3$ was 0.56. An AgCl emulsion with an average particle diameter of 0.725 $\mu$m was obtained.

The emulsion contained 50 nmol $K_2IrCl_6$ and 250 nmol $K_4Fe(CN)_6$ per mol Ag.

The emulsion was ripened at a pH of 5.3 with the optimum amount of gold(III) chloride and $Na_2S_2O_3$, at a temperature of 50° C. for 2 hours. After chemical ripening, the emulsion was, per mol AgCl, spectrally sensitised at 40° C. with 0.3 mmol of compound (IX-17), was stabilised with 0.5 mmol of compound (Stab 1) and subsequently treated with 0.6 mmol KBr.

Stab-1:

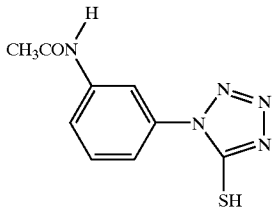

bisthioether: $H_5C_2SCH_2CH_2SCH_2CH_2NHCONH_2$

EmB2

Precipitation, redispersion, chemical ripening and spectral sensitisation were carried out as for EmB1. After sensitisation, the emulsion was stabilised with 0.5 mmol of compound (Stab 2) per mol AgCl instead of compound (Stab 1).

Stab-2:

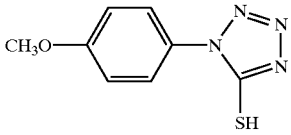

Green-Sensitive Emulsions EmGI-EmG3

EmG1

The following solutions were made up with demineralised water:

| | | |
|---|---|---|
| Solution 21 | 1100 g | water |
| | 136 g | gelatine |
| | 1 g | n-decanol |
| | 4 g | NaCl |
| | 186 g | EmMl |
| Solution 22 | 1860 g | water |
| | 360 g | NaCl |
| | 565.4 μg | $K_2IrCl_6$ |
| | 3414 μg | $K_4Fe(CN)_6$ |
| Solution 23 | 1800 g | water |
| | 1000 g | $AgNO_3$ |

Solutions 22 and 23 were added simultaneously and with intensive stirring to solution 21, which had been placed in the precipitation vessel, at 40° C. over 75 minutes at pAg 7.7. The pAg and pH were controlled as for the precipitation of emulsion EmM1. The addition was controlled so that during the first 50 minutes the flow rate of solutions 22 and 23 increased linearly from 4 ml/min to 36 m/min; during the remaining 25 minutes a constant flow rate of 40 ml/min was employed. An AgCl emulsion with an average particle diameter of 0.52 μm was obtained. The emulsion contained 200 mmol $Ir^{4+}$ and 2 μmol $K_4Fe(CN)_6$ per mol AgCl. The ratio by weight of gelatine to $AgNO_3$ was 0.14. The emulsion was ultrafiltered, washed and redispersed with an amount of gelatine and water such that the ratio by weight of gelatine to $AgNO_3$ was 0.56 and the emulsion contained 200 g $AgNO_3$ per kg.

1.25 kg of the emulsion (corresponding to 250 g $AgNO_3$) was subjected to the optimum ripening procedure at a pH of 5.3 with gold(III) chloride and $Na_2S_2O_3$ at a temperature of 60° C. for 2 hours. After chemical ripening, the emulsion was, per mol AgCl, spectrally sensitised with 0.6 mmol of compound (Sens G) at 50° C., was stabilised with 1.2 mmol of compound (Stab 3) and was subsequently treated with with 1 mmol KBr.

SensG:

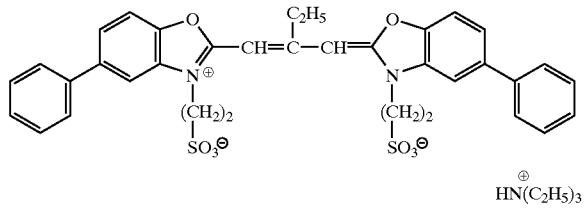

Stab-3:

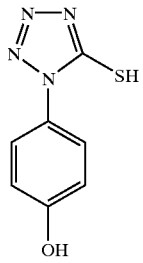

EmG2

The procedure was as for EmG1, except that Stab-3 was replaced by 0.6 mmol Stab-2 per mol AgCl.

EmG3

The procedure was as for EmG1, except that Stab-3 was replaced by 0.6 mmol Stab-4 per AgCl.

Stab-4:

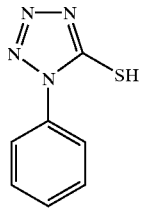

Red-Sensitive Emulsions EmR1 and EmR2

EmR1

Precipitation, desalination and redispersion were effected as for the green-sensitive emulsion EmG1, except that the compound $K_2IrCl_6$ in solution 22 was replaced by 5654 μg $K_2IrCl_4F_2$. The emulsion was chemically ripened with the optimum amount of gold(III) chloride and $Na_2S_2O_3$ for 2 hours at a temperature of 75° C. After chemical ripening, the emulsion was spectrally sensitised at 40° C. with 50 μmol of compound (X-1) and with 25 μmol of compound (XI-12) per mol AgCl, and was stabilised with 1 mmol (Stab 1) and 2.5 mmol (Stab 5) per mol $AgNO_3$. 3 mmol per mol AgCl KBr were subsequently added.

Stab-5:

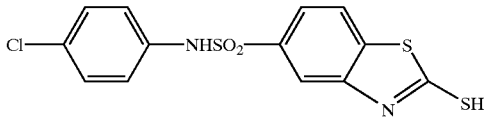

EmR2

As for EMRI, except that Stab-1 was replaced by 0.6 mmol Stab-4 per mol AgCl

Layer Structures

A color photographic recording material was produced by coating the following layers in the given sequence on a paper base coated on both sides with polyethylene. The quantitative data are given with respect to 1 $m^2$ in each case. The corresponding amounts of $AgNO_3$ are quoted for silver halide deposition.

Layer Structure 1

1 st Layer (substrate layer)

0.3 g gelatine

2nd layer (blue-sensitive layer):

EmB1 comprising 0.35 g $AgNO_3$ 0.635 g gelatine 0.45 g yellow coupler IV-11

0.25 g tricresyl phosphate (TCP)

3rd layer (intermediate layer):

1.1 g gelatine 0.2 g scavenger SC 0.2 g TCP

4th layer (green-sensitive layer):

EmG1 comprising 0.14 g $AgNO_3$ 1.2 g gelatine 0.14 g magenta coupler III-2

0.20 g colour stabilizer ST-1

0.10 g colour stabilizer ST-2

0.19 g of a polymer of trimethylolpropane and caprolactone 0.19 g of a mixture comprising 75% by weight dodecanol and 25% by weight tetradecanol 5th layer (UV protection layer):

1.1 g gelatine 0.125 g SC 0.0125 g white coupler 0.418 g V absorber UV 0.1375 g TCP 0.266 g solvent O-1

6th layer (red-sensitive layer):

EmR1 comprising 0.24 g $AgNO_3$ with 0.75 g gelatine 0.38 g cyan coupler VI-2

0.42 g TCP

7th layer (UV protection layer):

0.35 g gelatine 0.18 g UV absorber UV-1

0.098 g solvent O-1

8th layer 0.28 g hardener HM

Layer Structure 2

As layer structure 1, except that the blue-sensitive emulsion in the 2nd layer was EmB2 comprising 0.35 g $AgNO_3$/$m^2$.

Layer Structure 3

As layer structure 1, except that the green-sensitive emulsion in the 4th layer was EmG2 comprising 0.14 g $AgNO_3$/$m^2$.

Layer Structure 4

As layer structure 1, except that the green-sensitive emulsion in the 4th layer was EmG3 comprising 0.14 g $AgNO_3$/$m^2$.

Layer Structure 5

As layer structure 1, except that the red-sensitive emulsion in the $6^{th}$ layer was EmR2 comprising 0.24 g $AgNO_3$/$m^2$.

Compounds used for the first time in layer structures 1 to 5:

SC

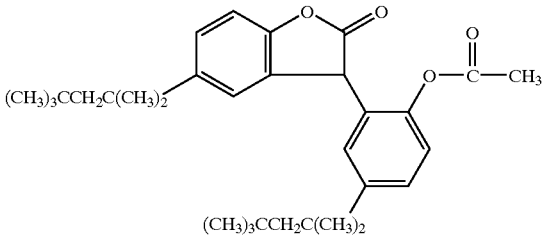

ST-1

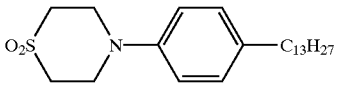

ST-2

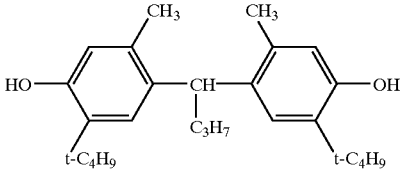

UV-1

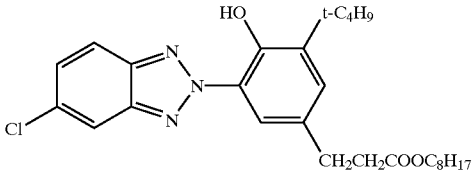

HM

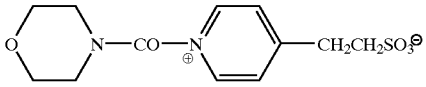

Ö-1

$C_8H_{17}OCO(CH_2)_8COOC_8H_{17}$

Processing

1. Analogue Exposure

Samples were exposed behind a graduated neutral wedge filter with a density gradation of 0.1/step for 40 msec and 5 sec under a constant amount of light from a halogen lamp.

2. Laser Exposure

The following laser exposure devices were used

| | |
|---|---|
| red laser: | a laser diode with wavelength of 683 nm |
| green laser: | a 514 nm argon gas laser |
| blue laser: | a 458 nm argon gas laser |
| optical resolution: | 400 dpi |
| pixel exposure time: | 131 nsec |
| colour graduations produced: | 256 per channel |

An area of the samples was first exposed for the given exposure time (131 nsec) at a luminous intensity I such that the density D after processing (see below) corresponded to about 0.6 (by X-Rite Status A measurement). The luminous intensity I was subsequently reduced or increased so that the logarithm of the amount of light log I.t was 0.1 less or 0.1 greater than that of the preceding step. This procedure was continued until a total of 29 steps had been exposed. The lowest step corresponded to a luminous intensity equal to zero.

Processing

The exposed samples were processed as follows, using Process AP 49:

| | |
|---|---|
| a) Colour developer-45 sec.-35° C. | |
| triethanolamine | 9.0 g |
| N,N-diethylhydroxylamine | 4.0 g |
| diethylene glycol | 0.05 g |
| 3-methyl-4-amino-N-ethyl-N-methane-sulphonamidoethyl-aniline sulphate | 5.0 g |
| potassium sulphite | 0.2 g |
| triethylene glycol | 0.05 g |
| potassium carbonate | 22 g |
| potassium hydroxide | 0.4 g |
| ethylenediaminetetraacetic acid, di-Na salt | 2.2 g |
| potassium chloride | 2.5 g |
| 1,2-dihydroxybenzene-3,4,6-trisulphonic acid, trisodium salt | 0.3 g |
| made up with water to 1000 ml; pH 10.0 | |
| b) Bleach hardener-45 sec.-35° C. | |
| ammonium thiosulphate | 75 g |
| sodium hydrogen sulphite | 13.5 g |
| ammonium acetate | 2.0 g |
| ethylenediaminetetraacetic acid (iron ammonium salt) | 57 g |
| 25% ammonia | 9.5 g |
| made up with water to 1000 ml; pH adjusted to 5.5 with acetic acid | |
| c) Washing - 2 min - 33 ° C. | |
| d) Drying | |

The results of integral analogue exposure and laser exposure are presented in the form of the following parameters:

| | |
|---|---|
| Dmin: | density in the unexposed region |
| sensitivity E: | abscissa to the density = 0.6 the density is given as the abscissa value (relative sensitivity value) |

-continued

| | |
|---|---|
| Gamma value G2: | shoulder graduation: is the gradient of the secant between the sensitivity point at sensity D = Dmin + 0.85 and the point on the curve at which the density D = Dmin + 1.60. |

Latent Image Behaviour

Experimental:

Unprocessed samples with layer structures 1 to 5 were subjected to analogue exposure in a sensitometer. After 5 min, 30 min, 6 hours and 24 hours, the exposed samples were processed using the AP 94 process described above. The yellow, magenta and cyan color densities of a grey area with a density of about 0.5 were subsequently measured. The change in density as a function of the delay between exposure and processing corresponded to the latent image behaviour of the material.

Results

| Layer structure | Light-sensitive layer | 131 nsec | 40 msec | 4.91 sec | Latent image behaviour 30'-1.5' | 6h-1.5' | 24h-1.5' | Remarks |
|---|---|---|---|---|---|---|---|---|
| 1 | yellow | 2.85 | 2.92 | 2.90 | 0.10 | 0.12 | 0.12 | com- |
| | magenta | 3.15 | 3.14 | 3.12 | 0.14 | 0.15 | 0.17 | parison |
| | cyan | 3.67 | 3.34 | 3.32 | 0.15 | 0.20 | 0.19 | |
| 2 | yellow | 2.90 | 2.98 | 2.95 | 0.05 | 0.03 | 0.04 | inven- |
| | magenta | 3.16 | 3.15 | 3.11 | 0.13 | 0.13 | 0.16 | tion |
| | cyan | 3.67 | 3.34 | 3.32 | 0.15 | 0.20 | 0.19 | |
| 3 | yellow | 2.87 | 2.92 | 2.91 | 0.09 | 0.10 | 0.12 | |
| | magenta | 3.20 | 3.20 | 3.18 | 0.03 | 0.02 | 0.05 | inven- |
| | cyan | 3.68 | 3.36 | 3.33 | 0.13 | 0.17 | 0.16 | tion |
| 4 | yellow | 2.88 | 2.89 | 2.88 | 0.08 | 0.10 | 0.11 | |
| | magenta | 3.10 | 3.12 | 3.14 | 0.04 | 0.05 | 0.07 | inven- |
| | cyan | 3.67 | 3.34 | 3.32 | 0.14 | 0.19 | 0.18 | tion |
| 5 | yellow | 2.99 | 2.96 | 2.95 | 0.09 | 0.10 | 0.11 | |
| | magenta | 3.20 | 3.18 | 3.17 | 0.13 | 0.14 | 0.16 | |
| | cyan | 3.87 | 3.54 | 3.50 | −0.02 | −0.03 | −0.02 | inven- tion |

It is clear that emulsions which contain the compound of formula (III) exhibit a d change in density and thus exhibit improved latent image stability.

What is claimed is:

1. A color photographic silver halide material which can be developed to form a negative, and which comprises a support, at least one blue-sensitive silver halide emulsion layer which contains at least one yellow coupler, at least one green-sensitive silver halide emulsion layer which contains as least one magenta coupler, and at least one red-sensitive silver halide emulsion layer which contains at least one cyan coupler, at least 95 mol % of the silver halides of which contains AgCl, and the material contains at least one light-sensitive silver halide emulsion layer which contains at least one compound of formulae (I) (II) and (III):

$$[IrCl_1F_{6-n}]^{2-}M^{2+} \quad (I)$$

wherein n is 0 or an integer from 1 to 6 and $M^{2+}$ is 1 or 2 cations with a total number of 2 positive charges, $$[Fe(CN)_6]^{m-}M^{m+} \quad (II)$$

wherein m is 2 or 3 and $M^{m+}$ is 1 to 3 cations with a total number of m positive charges, (III)

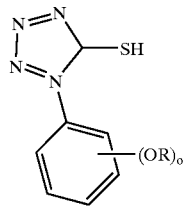

wherein o is 0, 1 or 2 and R is an alkyl, aryl or aralkyl.

2. The color photographic silver halide material according to claim 1, wherein the amount of compound (I) ranges from 10 nmol to 5 μmol per mol AgCl, the amount of compound (II) ranges from 10 nmol to 10 μmol per mol AgCl and the amount of compound (III) ranges from 0.1 mmol to 5 mmol per mol AgCl.

3. The color photographic silver halide material according to claim 1, wherein the silver halide is additionally doped with at least one metal of group IVA, with a further metal of group VIIIB, or with a metal of group IIB of the periodic table of the elements, or with Ga, In, Tl, Ge, Sn, Pb, Re, Au, Pr or Ce.

4. The color photographic silver halide material according to claim 1, wherein the silver halide emulsion is blue-sensitive and contains at least one compound of formula IX (IX)

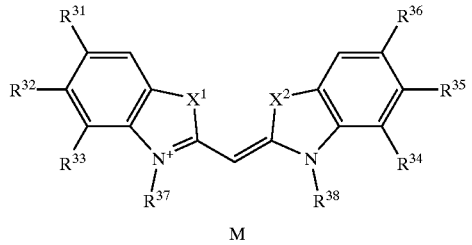

wherein $X^1$ and $X^2$ independently of each other, are S or Se, $R^{31}$ to $R^{36}$ independently of each other, are a hydrogen atom, a halogen atom, an alkyl, alkoxy, aryl or hetaryl group, or $R^{31}$ and $R^{32}$, or $R^{32}$ and $R^{33}$, and $R^{34}$ and $R^{35}$, or $R^{35}$ and $R^{36}$ are the remaining members of a condensed-on benzene, naphthalene or heterocyclic ring, $R^{37}$ and $R^{38}$ independently of each other, are an alkyl, sulphoalkyl, carboxyalkyl, —$(CH_2)_aSO_2R^{39}SO_2$-alkyl, —$(CH_2)_aSO_2R^{39}CO$-alkyl, —$(CH_2)_aCOR^{39;SO}{}_2$-alkyl or —$(CH_2)_a$—$COR^{39}CO$-alkyl group, $R^{39}$ is —N— or —NH—, a is an integer from 1 to 6, and M is counterion which may be necessary for charge equalization.

5. The color photographic silver halide material according to claim 1, wherein at least one blue-sensitive layer contains at least one yellow coupler of formula IV (IV)

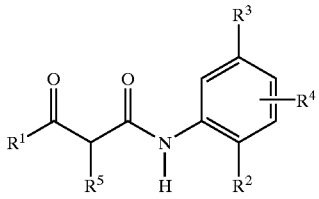

wherein $R^1$ is an alkyl, alkoxy, aryl or hetaryl, $R^2$ is an alkoxy, aryloxy or halogen, $R^3$ is —$CO_2R^6$, —$CONR^6R^7$, —$NHCO_2R^6$, —$NHSO_2$—$R^6$, —$SO_2NR^6R^7$, —$SO_2NHCOR^6$ or —$NHCOR^6$, $R^4$ is hydrogen or a substituent, $R^5$ is hydrogen or a radical which can be split off during coupling, $R^6$ and $R^7$ independently of each other, are hydrogen, alkyl or aryl and one of the $R^2$, $R^3$ and $R^4$ radicals is a ballast radical.

6. The color photographic silver halide material according to claim 1, wherein the silver halide emulsion is red-sensitive and contains at least one compound of formulae X or XI (X)

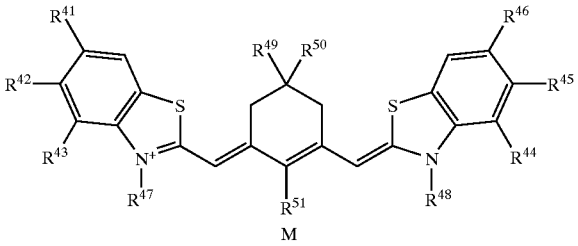

(XI)

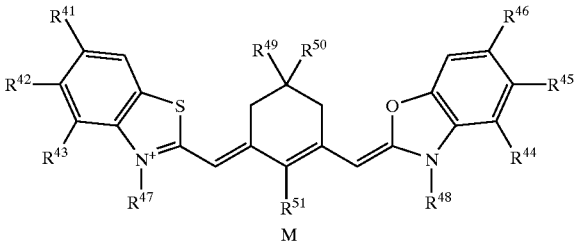

wherein $R^{41}$ to $R^{46}$ independently of each other, are a hydrogen atom, a halogen atom, and alkyl, alkoxy, aryl or hetaryl group, or $R^{31}$ and $R^{32}$, or $R^{32}$ and $R^{33}$, and $R^{34}$ and $R^{35}$, or $R^{35}$ and $R^{36}$ are the remaining members of a condensed-on benzene, naphthalene or heterocyclic ring, $R^{47}$ and $R^{48}$ independently of each other, are an alkyl, sulphoalkyl, carboxyalkyl, —$(CH_2)_aSO_2R^{39}SO_2$-alkyl, —$(CH_2)_aSO_2R^{39}CO$-alkyl, —$(CH_2)_aCOR^{39}SO_2$-alkyl or —$(CH_2)_a$—$COR^{39}CO$-alkyl group, a is an integer from 1 to 6, $R^{49}$ and $R^{50}$ independently of each other, are a hydrogen atom, an alkyl or aryl group, $R^{51}$ is a hydrogen atom, a halogen atom or an alkyl group, and M is a counterion which may be necessary for charge equalization.

7. The color photographic silver halide material according to claim 1, wherein the at least one green-sensitive layer contains at least one magenta coupler of formulae V or VI, (V)

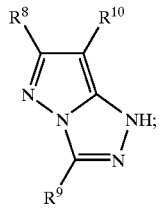

(VI)

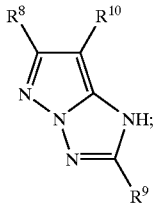

wherein $R^8$ and $R^9$ independently of each other, are hydrogen, an alkyl radical, an aralkyl radical, an aryl radical, an aryloxy radical, an alkylthio radical, an arylthio radical, an amino radical, an anilino radical, an acylamino radical, a cyano radical, an alkoxycarbonyl radical, an alkylcarbamoyl radical or an alkylsulphamoyl radical, wherein each of said radicals can be further substituted and wherein at least one of said radicals contains a ballast group, and $R^{10}$ is hydrogen or a radical which can be split off during chromogenic coupling.

8. The color photographic silver halide material according to claim 1, wherein the at least one red-sensitive layer contains at least one cyan coupler of formulae VII or VIII (VII)

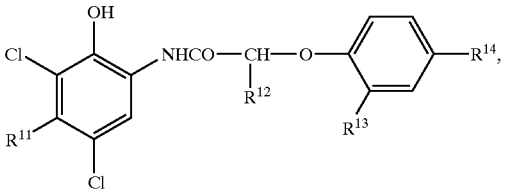

wherein $R^{11}$, $R^{12}$, $R^{13}$ and $R^{14}$ independently of each other, are hydrogen or a $C_1$–$C_6$ alkyl group;

(VIII)

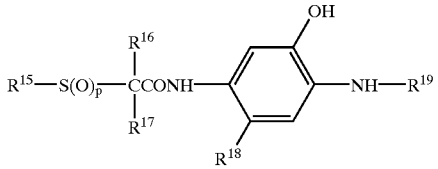

wherein $R^{15}$ is alkyl, alkenyl, aryl or hetaryl, $R^{16}$ and $R^{17}$ independently of each other, are H, alkyl, alkenyl, aryl or hetaryl, $R^{18}$ is H or a group which can be split off under the conditions of chromogenic development, $R^{19}$ is $—COR^{20}$, $—CO_2R^{20}$, $—CONR^{20}R^{21}$, $SO_2R^{20}$, $—SO_2NR^{20}R^{21}$, $—CO—CO_2R^{20}$, $—COCONR^{20}R^{21}$ or a group of formula

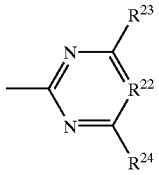

$R^{20}$ is alkyl, alkenyl, aryl or hetaryl, $R^{21}$ is H or $R^{20}$, $R^{22}$ is —N= or $—C(R^{25})=$, $R^{23}$, $R^{24}$ and $R^{25}$ of each other are $OR^{21}$, $—SR^{21}$, $—NR^{20}R^{21}$, $—R^{21}$ or Cl, and p is 1 or 2.

9. The color photographic silver halide material according to claim 7, wherein $R^8$ is tert.-butyl, and $R^{10}$ is chlorine.

10. The color photographic silver halide material according to claim 8, wherein $R^{11}$ is $CH_3$ or $C_2H_5$, $R^{12}$ is a $C_2$–$C_6$ alkyl, $R^{13}$ and $R^{14}$ independently of each other are t-$C_4H_9$ or t-$C_5H_{11}$, $R^{15}$ is alkyl or aryl, $R^{16}$ and $R^{17}$ independently of each other are H, alkyl or aryl, $R^{18}$ is H, Cl, alkoxy, aryloxy, alkylthio or arylthio, $R^{22}$ is —N=, $R^{23}$ and $R^{24}$ independently of each other are $—OR^{21}$, $—NR^{20}R^{21}$ or Cl.

11. The color photographic silver halide material according to claim 10, wherein $R^{17}$ is H and $R^{20}$ is an alkyl or an aryl.

* * * * *

UNITED STATES PATENT AND TRADEMARK OFFICE

CERTIFICATE OF CORRECTION

PATENT NO. : 6,689,552 B2
DATED : February 10, 2004
INVENTOR(S) : Cuong Ly et al.

It is certified that error appears in the above-identified patent and that said Letters Patent is hereby corrected as shown below:

Column 79,
Line 57, "$-(CH_2)_aCOR^{39;SO}{}_2$-alkyl" should read -- $(CH_2)_aCOR^{39}SO_2$-alkyl --.

Column 82,
Line 31, after "$R^{25}$" insert -- independently --.

Signed and Sealed this

Twentieth Day of April, 2004

JON W. DUDAS
*Acting Director of the United States Patent and Trademark Office*